US007822379B2

(12) United States Patent
Nakamura et al.

(10) Patent No.: US 7,822,379 B2
(45) Date of Patent: Oct. 26, 2010

(54) IMAGE FORMING APPARATUS

(75) Inventors: Hiroyuki Nakamura, Kanagawa (JP); Akihiro Yamada, Kanagawa (JP); Tetsuo Uchida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 95 days.

(21) Appl. No.: 11/043,051

(22) Filed: Jan. 27, 2005

(65) Prior Publication Data

US 2005/0232672 A1 Oct. 20, 2005

(30) Foreign Application Priority Data

Mar. 31, 2004 (JP) ..... 2004-104163

(51) Int. Cl.
*G03G 15/00* (2006.01)
*B65H 85/00* (2006.01)

(52) U.S. Cl. ..... 399/405; 399/401; 271/278

(58) Field of Classification Search ..... 399/401, 399/405; 271/3.14, 3.17, 278, 292, 207; *G03G 15/00; B65H 85/00*
See application file for complete search history.

(56) References Cited

U.S. PATENT DOCUMENTS

| | | | | |
|---|---|---|---|---|
| 5,033,731 | A * | 7/1991 | Looney | 271/176 |
| 5,839,032 | A | 11/1998 | Yasui et al. | |
| 6,381,442 | B1 | 4/2002 | Okitsu et al. | |
| 6,647,243 | B2 * | 11/2003 | Sato et al. | 399/407 |
| 6,671,472 | B2 * | 12/2003 | Shimizu et al. | 399/82 |
| 6,725,011 | B2 * | 4/2004 | Sato | 399/405 |
| 6,823,168 | B2 * | 11/2004 | Sakuma | 399/405 |
| 6,836,642 | B2 * | 12/2004 | Miyake | 399/401 |
| 6,848,685 | B2 * | 2/2005 | Katsuyama | 271/162 |

FOREIGN PATENT DOCUMENTS

| | | | |
|---|---|---|---|
| JP | 06250463 A | * | 9/1994 |
| JP | 06250464 A | * | 9/1994 |
| JP | 08208091 A | * | 8/1996 |
| JP | 09-301602 | | 11/1997 |

(Continued)

OTHER PUBLICATIONS

English Translation of JP 10069137 A.*

*Primary Examiner*—Ren Yan
*Assistant Examiner*—'Wyn' Q Ha
(74) *Attorney, Agent, or Firm*—Morgan, Lewis & Bockius LLP

(57) ABSTRACT

An image forming apparatus includes: a main body discharge tray disposed in an image forming apparatus main body, onto which a sheet with an image recorded is discharged; a main body discharge member that discharges the sheet onto the main body discharge tray; an optional discharge device disposed above the main body discharge member, the optional discharge device having an optional transport path through which the sheet passes and an optional discharge member that discharges the sheet; a postprocessing device that performs postprocessing on the sheet; and a postprocessing transport device disposed above the main body discharge tray, the postprocessing transport device having a lower portion, an upper portion on which the sheet discharged from the optional discharge member is placed and a postprocessing transport path formed between the lower and upper portions, the postprocessing transport path transporting the sheet discharged from the main body discharge member to the postprocessing device.

13 Claims, 27 Drawing Sheets

FOREIGN PATENT DOCUMENTS

| | | | |
|---|---|---|---|
| JP | 10069137 A | * | 3/1998 |
| JP | 10-152241 | | 6/1998 |
| JP | 10-181978 | | 7/1998 |
| JP | 2001-247245 | | 9/2001 |
| JP | 2001-287846 | | 10/2001 |
| JP | 2002-274735 | | 9/2002 |
| JP | 2003326801 A | * | 11/2003 |

* cited by examiner

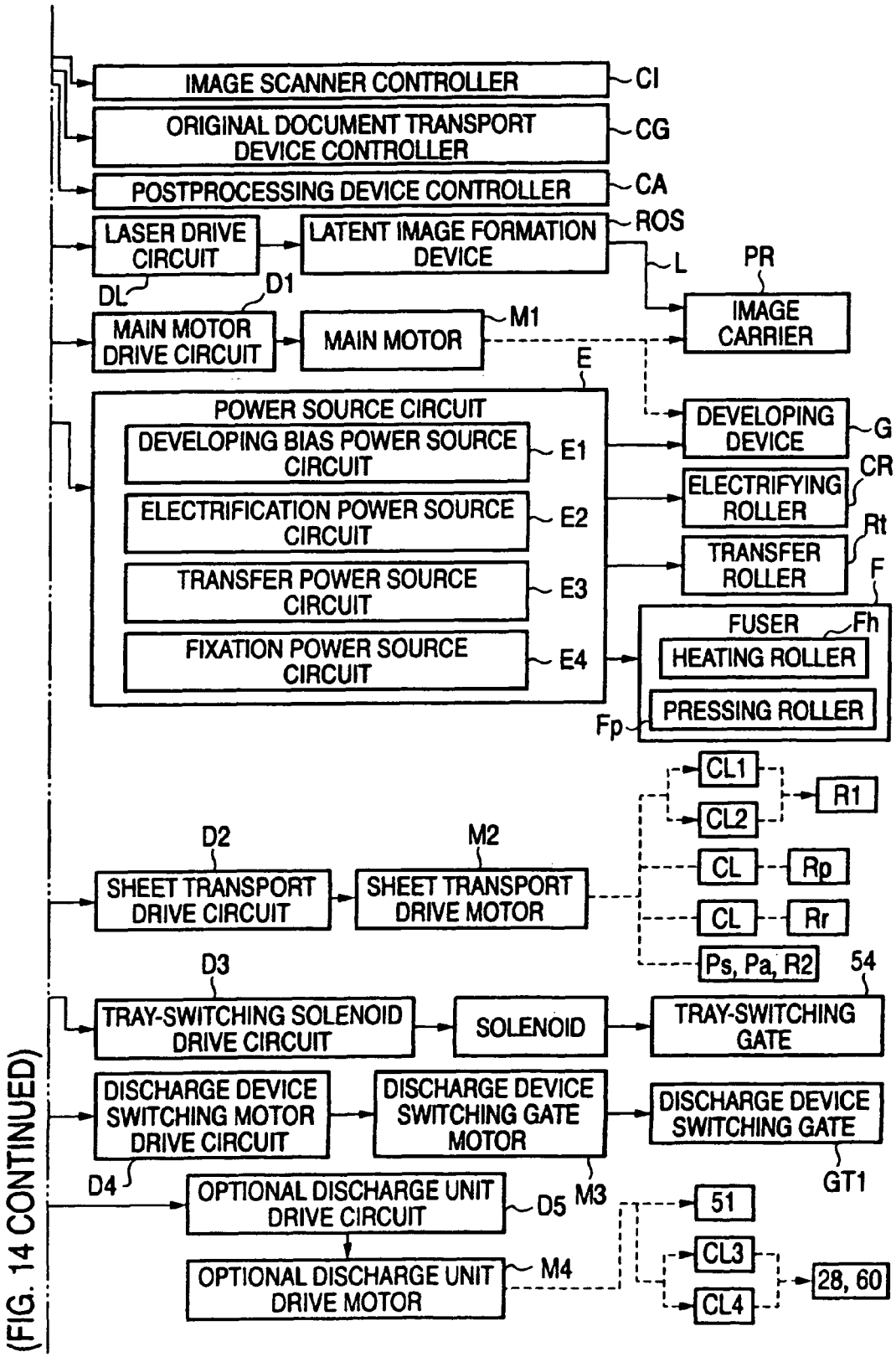
(FIG. 14 CONTINUED)

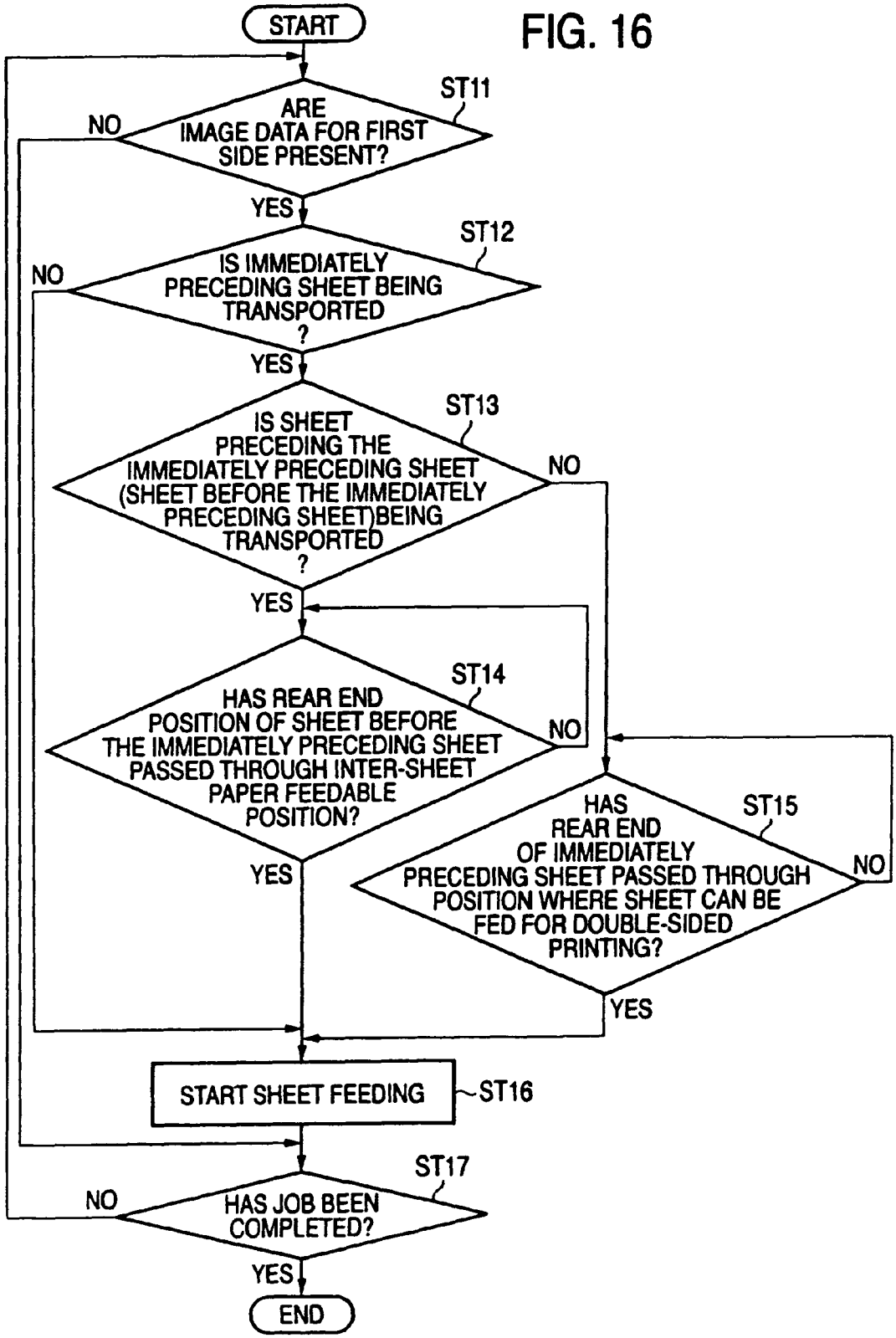
FIG. 16
START
ST11
ARE IMAGE DATA FOR FIRST SIDE PRESENT?
NO
YES
ST12
IS IMMEDIATELY PRECEDING SHEET BEING TRANSPORTED ?
NO
YES
ST13
IS SHEET PRECEDING THE IMMEDIATELY PRECEDING SHEET (SHEET BEFORE THE IMMEDIATELY PRECEDING SHEET)BEING TRANSPORTED ?
NO
YES
ST14
HAS REAR END POSITION OF SHEET BEFORE THE IMMEDIATELY PRECEDING SHEET PASSED THROUGH INTER-SHEET PAPER FEEDABLE POSITION?
NO
YES
ST15
HAS REAR END OF IMMEDIATELY PRECEDING SHEET PASSED THROUGH POSITION WHERE SHEET CAN BE FED FOR DOUBLE-SIDED PRINTING?
NO
YES
START SHEET FEEDING
ST16
ST17
HAS JOB BEEN COMPLETED?
NO
YES
END

IMAGE FORMING APPARATUS

BACKGROUND OF THE INVENTION

1. Field of the Invention

The present invention relates to an image forming apparatus such as a facsimile machine, a printer, or a copier, and more particularly to an image forming apparatus including a postprocessing device, such as a stapler for stapling a bundle of sheets or a punching device for forming punched holes.

2. Description of the Related Art

An image forming apparatus including a postprocessing device, such as a stapler for stapling a bundle of sheets on which images have been recorded and thereafter discharged, and a punching unit for forming punched holes on a bundle of sheets, has hitherto been known. There has also been known another image forming apparatus, wherein, when a sheet is transported to a postprocessing device from an image forming apparatus main body where an image is recorded on the sheet, a postprocessing sheet transport device including a transport path for transporting the sheet to the postprocessing device is attached on a main body discharge tray of the image forming apparatus main body. JP-A-10-152241 and JP-A-9-301602 disclose an image forming apparatus including the postprocessing sheet transport device.

JP-A-10-152241 discloses a postprocessing sheet transport device which includes a transport mechanism (12) for transporting a sheet to a sheet postprocessing device, and a discharge member for discharging a sheet to an optional discharge tray (a stack section 21) formed on an upper surface of a transport device, and which is attached to the upper surface of the discharge tray (a stack section 9) of the image forming apparatus main body. According to the technique disclosed in JP-A-10-152241, inside the postprocessing sheet transport device a switch is made in the transport direction of a sheet discharged from a discharge roller (8) of the image forming apparatus main body, thereby transporting the sheet to the optional discharge tray or to the postprocessing device.

JP-A-9-301602 discloses a postprocessing sheet transport device (relay transport means 16, 120) which is identical with the postprocessing sheet transport device described in JP-A-10-152241. JP-A-9-301602 also describes a postprocessing sheet transport device, wherein an optional discharge device (a one-bin device 121) is disposed above a discharge roller of an image forming apparatus main body; and a discharge tray (125) on which a sheet discharged from the optional discharge device (121) is placed is disposed further above a discharge tray (transport cover 38) on the upper surface of the postprocessing sheet transport device.

However, in JP-A-10-152241 and JP-A-9-301602, the destination of a transport (the postprocessing device or the optional discharge tray) of the sheet which has been transported to the postprocessing sheet transport device by the discharge member (discharge roller) of the main body is switched inside the postprocessing transport device. Therefore, in JP-A-10-152241 and JP-A-9-301602, a switching device must be provided inside the postprocessing sheet transport device for switching a transport path between two transport paths. Accordingly, there arises a problem that a structure of the postprocessing sheet transport device is complicated, and cost is increased.

In addition, there arises another problem that, since the switching device or the like is disposed, the optional discharge tray in the postprocessing device transport device is shorter in length than a discharge tray of the main body, whereby a sheet that can be housed in the optional discharge tray is decreased in size. When the optional discharge tray is increased in length in order to solve the problem, there arises a problem that the postprocessing sheet transport device and the image forming apparatus are increased in overall size.

Meanwhile, when the discharge tray for the optional discharge device described in JP-A-9-301602 is disposed, a gap between the discharge tray of the postprocessing sheet transport device and the discharge tray of the optional discharge device is narrowed. Therefore, there arises a problem that the number of sheets that can be stacked on the discharge tray of the postprocessing sheet transport device is decreased. In addition, there arises another problem that a narrow gap between the trays makes it difficult for a user to take out a sheet from the discharge tray of the postprocessing transport device.

SUMMARY OF THE INVENTION

In view of the above circumstances, the present invention provides an image forming apparatus in which:

- a decrease in size of the discharge tray of the postprocessing sheet transport device to be attached to the main body discharge tray is prevented;
- the number of sheets that can be stacked on the discharge tray of the postprocessing sheet transport device is increased; and
- taking out of a sheet discharged onto the discharge tray of the postprocessing sheet transport device is facilitated.

According to an aspect of the invention, there is provided an image forming apparatus including: a main body discharge tray disposed on an image forming apparatus main body and having a main body sheet placing surface onto which a sheet with an image recorded thereon is discharged; a main body discharge member for discharging a sheet onto the main body discharge tray; an optional discharge device having an optional transport path through which the sheet, on which an image has been recorded in the image forming apparatus main body, passes and an optional discharge member for discharging the sheet which has passed through the optional transport path, the optional discharge device being detachably attachable above the main body discharge member; a postprocessing device for performing postprocessing of the sheet on which an image has been recorded; and a postprocessing sheet transport device having a lower supported surface which is supported on the main body sheet placing surface, and an upper optional placement surface on which the sheet discharged from the optional discharge member is placed, wherein solely a postprocessing sheet transport path for transporting the sheet discharged from the main body discharge member to the postprocessing device is formed between the supported surface and the optional placement surface.

BRIEF DESCRIPTION OF THE DRAWINGS

Embodiments of the present invention will be described in detail based on the following figures, wherein:

FIGS. 3A to 3C are perspective explanatory views describing a state where an optional discharge unit is attached to the image forming apparatus of the invention, wherein FIG. 3A is an overall perspective explanatory view, FIG. 3B is an enlarged explanatory view of an essential portion indicated by an arrow IIIB of FIG. 3A, and FIG. 3C is an enlarged explanatory view of another essential portion indicated by an arrow IIIC of FIG. 3A;

FIGS. 6A and 6B are perspective explanatory views of the optional discharge unit as viewed from the face-up tray, wherein FIG. 6A is a perspective explanatory view of a state where the face-up tray is not attached, and FIG. 6B is a perspective explanatory view of a state where the face-up tray is attached;

FIGS. 9A and 9B are cross-sectional explanatory views of an essential portion of the optional discharge unit, wherein FIG. 9A is a cross-sectional explanatory view of a state where the face-up tray is not attached, and FIG. 9B is cross-sectional explanatory view of a state where the face-up tray is attached;

FIG. 16 is a flowchart depicting feed processing of the paper feed processing for double-sided printing under designation of the main body discharge tray, and is a flowchart depicting a subroutine of ST7 shown in FIG. 15;

FIGS. 20A and 20B are explanatory views of a sheet transported through the sheet path at the time of double-sided printing of the first embodiment, wherein FIG. 20A is a view showing a state immediately after supply of a first sheet, and FIG. 20B is a view showing a state immediately after supply of a second sheet;

FIGS. 21A and 21B are explanatory views of a sheet transported through the sheet path at the time of double-sided printing of the first embodiment, wherein FIG. 21A is a view showing a state immediately after supply of a third sheet, and FIG. 21B is a view showing a state where the first sheet passes through below the discharge device switching gate and where the second sheet passes through above the same;

FIGS. 23A and 23B are front views of an image forming apparatus of a second embodiment, wherein FIG. 23A is a front view of a state where the optional discharge unit is not attached, and FIG. 23B is a view where the single optional discharge unit is attached;

DETAILED DESCRIPTION OF THE INVENTION

Figure 1:
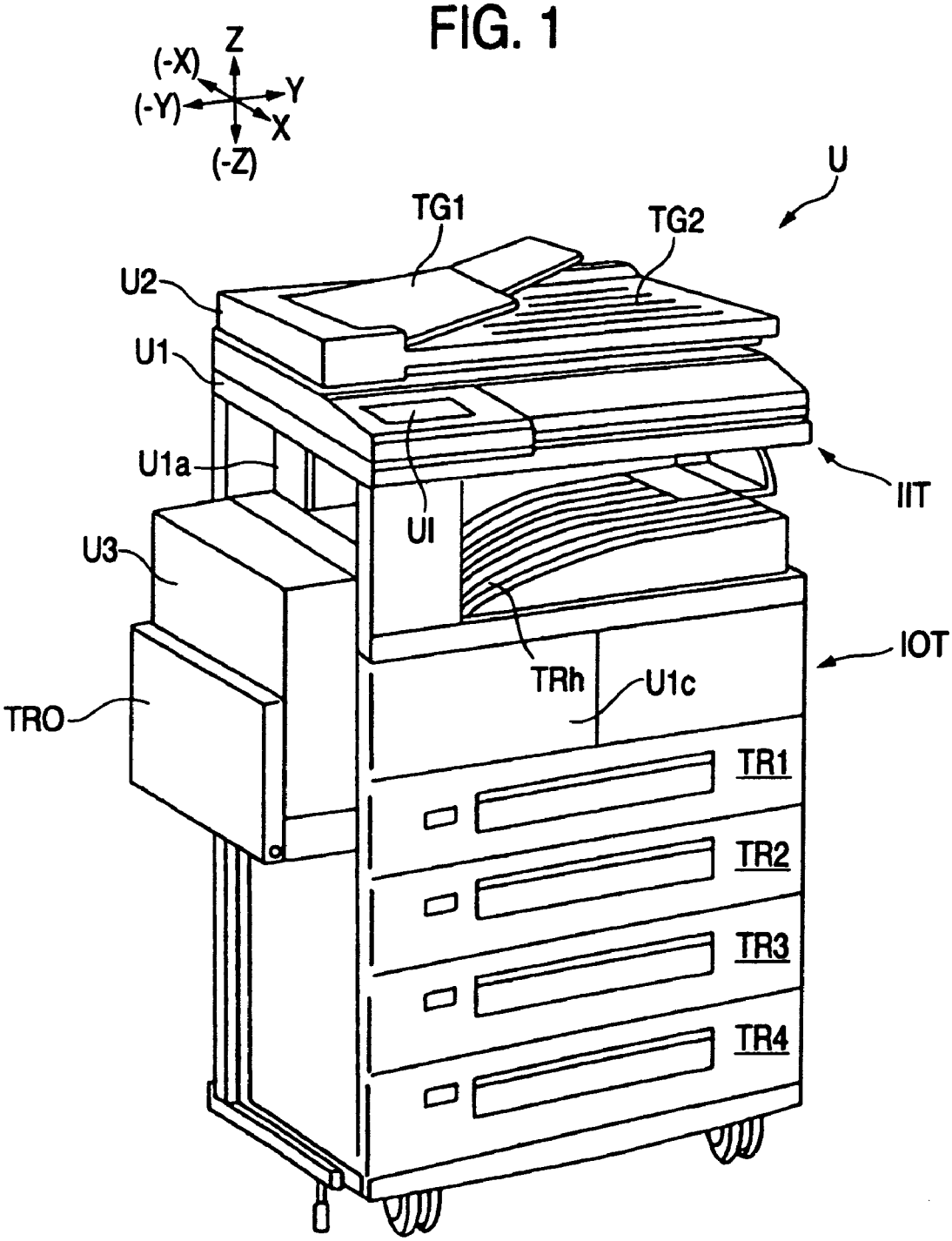
FIG. 1 is a perspective explanatory view of an image forming apparatus of a first embodiment of the invention.

Next, the present invention, which have solved the above-mentioned problems, will be described. In order to facilitate comparison of elements of the present invention with elements in embodiments, which will be described later, elements of the invention are appended with reference numerals of embodiments, enclosed in parentheses. In addition, the invention is described in correspondence with the reference numerals of the embodiments, which will be described later, in order to facilitate understanding of the invention, and should not be construed as limiting the range of the inventions to the embodiments.

To solve the technical problems, an image forming apparatus according to a first aspect of the invention is characterized by including the following constitutional elements:

- a main body discharge tray (TRh) which is disposed on an image forming apparatus main body (U1, U1'), and which includes a main body sheet-receiving face onto which is discharged a sheet on which an image has been recorded;
- a main body discharge member (R1) for discharging the sheet onto the main body discharge tray (TRh);
- an optional discharge device (U6, U6') which includes an optional transport path (61, 63) through which the sheet on which the image has been recorded in the image forming apparatus main body (U1, U1') passes, and an optional discharge member (28) for discharging the sheet which has passed through the optional transport path (61, 63), wherein the optional discharge device (U6, U6') is detachably attached above the main body discharge member (R1);
- a postprocessing device (U4) for performing postprocessing of the sheet on which the image has been recorded; and
- a postprocessing sheet transport device (U5) which includes a lower supported surface (U5*c*) which is supported on the main body sheet receiving face; and an upper optional receiving face (TRh1) on which the sheet which has been discharged from the optional discharge member (28) is placed, wherein solely a postprocessing sheet transport path (SH2) for transporting a sheet discharged from the main body discharge member (R1) to the postprocessing device (U4) is formed between the supported surface (U5*c*) and the optional receiving face (TRh1).

In the image forming apparatus according to the first aspect of the invention including the constitutional elements, a sheet on which an image has been recorded is discharged onto the main body discharge tray (TRh) disposed on the image forming main body (U1, U11'), by means of the main body discharge member (R1). The lower supported surface (U5*c*) of the postprocessing sheet transport device (U5) is supported by the main body sheet-receiving face of the main body discharge tray (TRh). On the upper optional receiving face (TRh1) of the postprocessing sheet transport device (U5), a sheet which has been discharged from the optional discharge member (28) of the optional discharge device (U6, U6') which is detachably attached to above the main body discharge member (R1) is placed. Between the supported surface (U5*c*) and the optional receiving face (TRh1), there is formed solely the postprocessing sheet transport path (SH2) for transporting the sheet discharged from the main body discharge member (R1) to the postprocessing device (U4) which performs postprocessing of the sheet on which an image has been recorded.

Therefore, in the image forming apparatus, solely the postprocessing sheet transport path (SH2) is formed in the postprocessing sheet transport device (U5); and there are not provided a transport path, a transport member, a switching gate, and the like, all of which are for transporting a sheet to the optional receiving face (TRh1) on the upper surface. Accordingly, reduction in size of the optional receiving face (TRh1) can be prevented.

In addition, since solely the postprocessing sheet transport path (SH2) is formed inside the postprocessing sheet transport device (U5), the postprocessing transport device (U5) has a simple structure, and does not include a switching gate, a control circuit for controlling the switching gate, and the like. As a result, a cost for the postprocessing sheet transport device (U5) provided with the optional receiving face (TRh1) of the optional discharge device and the postprocessing sheet transport path (SH2) can be reduced.

In addition, since solely the postprocessing sheet transport path (SH2) is formed inside the postprocessing sheet transport device (U5), the postprocessing transport device (U5) has a simple structure. Accordingly, a distance from the postprocessing sheet transport path (SH2) to the optional receiving face (TRh1) can be decreased. Therefore, even when members such as an image-reading device (image input terminal, hereinafter referred to as "IIT") or the like is disposed above the main body sheet-receiving face, the distance between the optional receiving face (TRh1) and the member mounted above the same can be extended. As a result, a number of sheets that can be stacked on the optional receiving face (TRh1) can be increased. In addition, since the distance from the optional receiving face (TRh1) to the member mounted above the same can be extended, a take-out opening is expanded, whereby a user can easily take out sheets placed on the optional receiving face (TRh1).

An image forming apparatus of a first embodiment of the first aspect of the invention is characterized by the following constitutional element:

the postprocessing sheet transport device (U5) is detachably attachable to the image forming apparatus main body (U1, U1').

In the image forming apparatus of the first embodiment including the constitutional element, the postprocessing sheet transport device (U5) is detachably attached to the image forming apparatus main body (U1, U1'). Accordingly, when the postprocessing device (U4) is attached to the image forming apparatus, the postprocessing apparatus (U4) can be used, on condition that the postprocessing sheet transport device (U5) is attached to the image forming apparatus, without changing the sheet transport path inside the image forming apparatus main body (U1, U1') or without disposing a sheet transport path for the postprocessing device in advance.

The hitherto described present invention exerts the following effects:

the discharge tray of the postprocessing sheet transport device to be attached to the discharge tray of the main body can be prevented from being reduced in size;

the number of sheets that can be stacked on the discharge tray of the postprocessing sheet transport device can be increased; and a sheet which has been discharged onto the discharge tray of the postprocessing sheet transport device can be easily taken out.

Now, embodiments of the present invention will be described by referring to drawings; however, the present invention is not limited to the embodiments.

Hereinafter, for the sake of easy understanding of the descriptions, in the drawings, the front-and-rear direction is assumed to be the X-axis direction, the horizontal direction is assumed to be the Y-axis direction, and the vertical direction is assumed to be the Z-axis direction. The directions or sides denoted by arrows X, −X, Y, −Y, Z, and −Z are respectively assumed to indicate: forward, rearward, rightward, leftward, upward, and downward; or, front side, rear side, right side, left side, upper side, and lower side.

In addition, in the drawings, a circle having a dot in the center denotes an arrow directed from the backside of the sheet to the surface side of the same. A circle having an X in the center denotes an arrow directed from the surface side of the sheet to the backside of the same.

First Embodiment

FIG. 1 is a perspective explanatory view of an image forming apparatus of a first embodiment of the invention.

Figure 2:
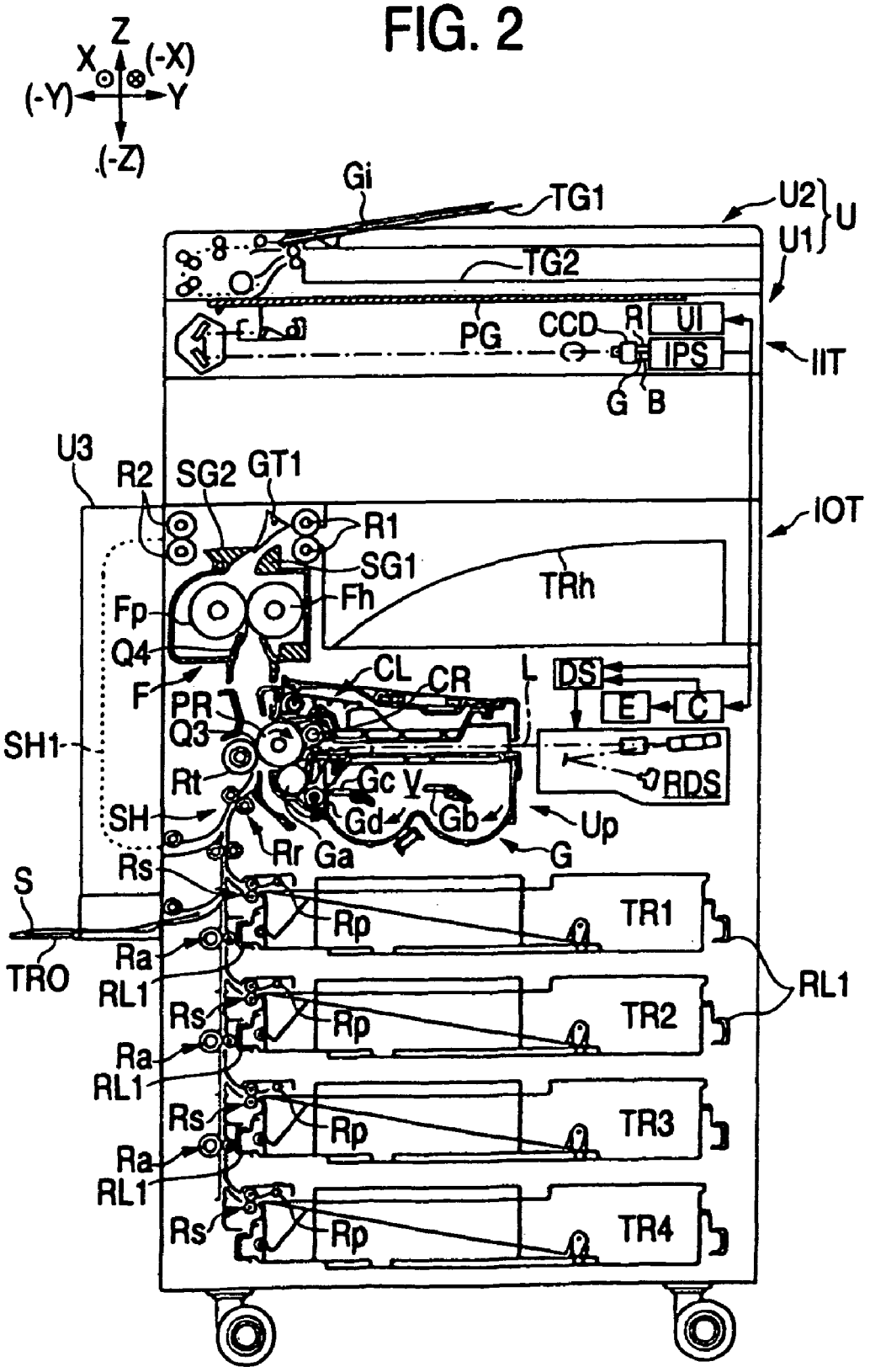
FIG. 2 is an explanatory view of an image forming apparatus of the first embodiment.

FIG. 2 is an explanatory view of the image forming apparatus of the first embodiment.

In FIGS. 1 and 2, a digital copier U, which is an image forming apparatus of the first embodiment, includes the image forming apparatus U1 and an automatic document transport device U2. A sheet-reversing device U3 is detachably attached onto the upper left side surface of the image forming apparatus main body U1.

The image forming apparatus main body U1 includes an IOT (image output terminal) and an IIT (image input terminal; i.e., an image-reading section).

The automatic document transport device U2 is supported on a platen glass PG on the upper surface of the IIT.

The sheet discharge tray (main body discharge tray) TRh is disposed between the upper surface of the IOT and the IIT located thereabove.

Figure 3A:
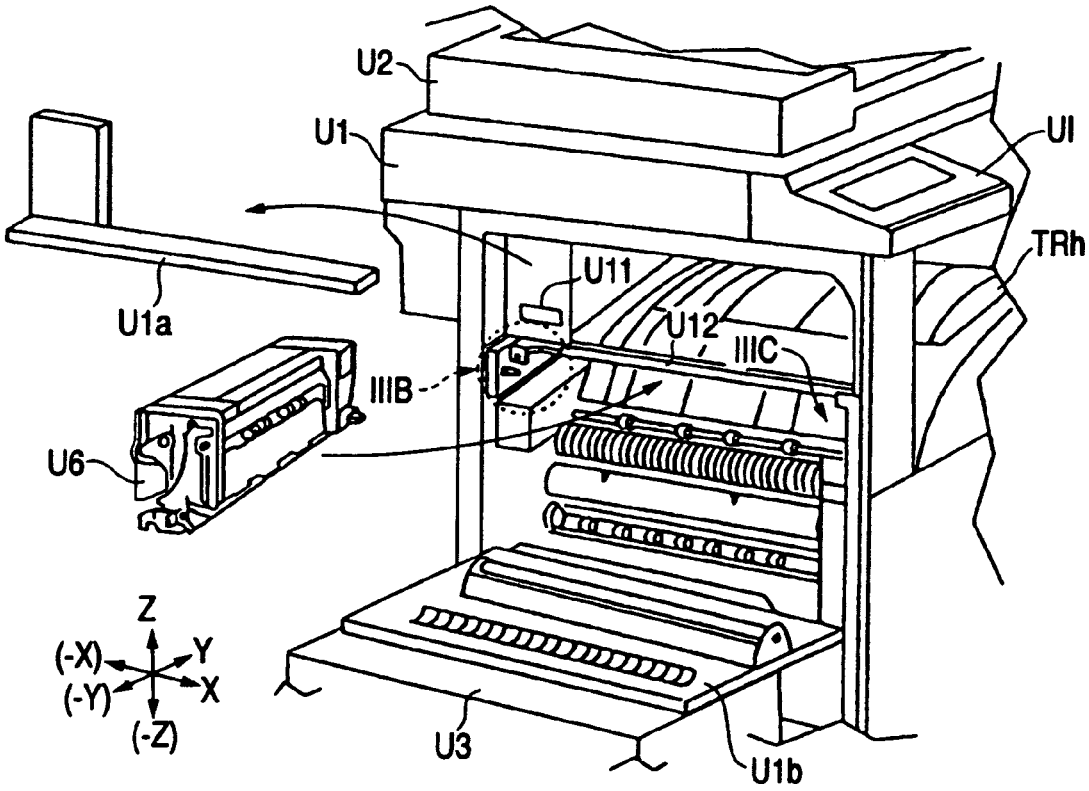
Figure 3B:
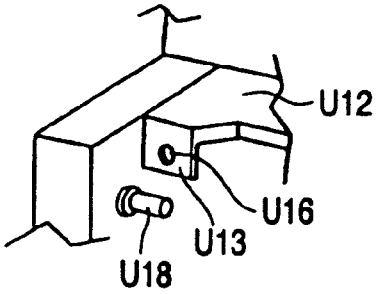
Figure 3C:
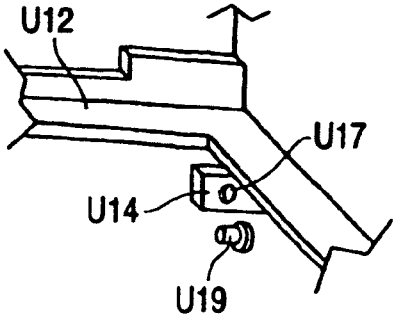

FIGS. 3A to 3C are perspective explanatory views describing a state where an optional discharge unit is attached to the image forming apparatus of the invention. FIG. 3A is an overall perspective explanatory view. FIG. 3B is an enlarged explanatory view of an essential portion indicated by an arrow IIIB in FIG. 3A. FIG. 3C is an enlarged explanatory view of another essential portion indicated by an arrow IIIC in FIG. 3A.

In FIGS. 1 and 3A to 3C, a top cover U1*a* is detachably attached to the upper left end of the sheet discharge tray TRh, and a left side cover U1*b* (see FIG. 3A) is pivotally supported on the upper left end of the sheet discharge tray TRh. The top cover U1*a* is removed when the optional discharge unit (U6), which will be described later, is attached. As shown in FIG. 3A, when the top cover U1*a* is removed, a main-body-side connector U11 (see FIG. 3A) and the upper left portion of the IOT are exposed. On the upper portion of the thus-exposed IOT, a right-portion-of-unit-support frame U12 extending in the longitudinal direction is disposed. A rear bracket U13 (see FIG. 3B) is formed at the rear end of the right-portion-of-unit-support frame U12. In FIG. 3C, a front bracket U14 protruding rearward is formed at the front end of the right-portion-of-unit-support frame U12. A discharge unit positioning hole U16 is formed in the bracket U13, and a discharge unit positioning hole U17 is formed in the bracket U14. Discharge unit lock pins U18, U19, which respectively protrude inward, are supported on the rear end and the front end of the frame, respectively.

In FIGS. 1 and 2, the automatic document transport device U2 has a document feed tray TG1 on which plural original documents Gi intended to be copied are stacked. The automatic document transport device U2 is configured such that the respective original documents Gi stacked on the document feed tray TG1 are discharged to a document discharge tray TG2 after sequentially passing through a copying position on the platen glass PG. The automatic document transport device U2 is pivotable in relation to the upper surface of the platen glass PG by means of a hinge axis (not shown) which is disposed at the rear end (X-end) of the automatic document transport device U2 and which extends horizontally. The automatic document transport device U2 is caused to pivot upward when an operator manually places an original document on the platen glass PG.

The image forming apparatus main body U1 has a UI (user interface) through which a user inputs and operates operation command signals such as "copy start" or the like.

In FIG. 2, an exposure optical system A for reading the document image is disposed below the transparent platen glass PG.

By way of the exposure optical system A, light reflected by the original document (not shown) transported onto the upper surface of the platen glass PG by the automatic document transport device U2 or manually placed is converted into electric signals from a CCD (charge coupled device).

An IPS (image processing system) converts electric signals inputted by the CCD into image data and stores the data tentatively, and outputs the data as image data for forming a latent image to a laser drive circuit DL at a predetermined timing.

The laser drive circuit DL outputs a laser drive signal to an ROS (a latent image forming device) in accordance with the inputted image data. Operations of the UI (user interface), the IPS, the laser drive signal output device DL, a power source circuit E for applying bias voltage to a developing roller Ga and a transfer roller Rt, and the like, are controlled by a controller C.

In FIG. 2, a toner image forming device Up for forming a black toner image is disposed to the left of the ROS. A laser beam L radiated from an unillustrated laser diodes of the latent image forming optical system ROS impinges a rotating photosensitive member PR.

In FIG. 2, the toner image forming device Up includes an image carrier PR constituted of a photosensitive drum rotating in the direction indicated by a narrow (see FIG. 2), an electrifying roller (electrifying member) CR, a developing device G, and a cleaner CL. The toner image forming device Up is embodied as a unit, and is configured so as to be detachably attached to the image forming apparatus main body U1 as a processing unit Up. Attachment and removal of the processing unit (toner image forming device) Up is performed in a state where a front cover U1*c* (see FIG. 1) which is supported on the image forming apparatus main body U1 at the front surface thereof in a reclosable manner is open.

The surface of the image carrier PR is electrified uniformly by the electrifying roller CR, and thereafter exposed to the laser beam L radiated from the ROS (latent image forming device) to thus be scanned, whereby a latent image is formed.

The surface of the image carrier PR on which the latent image is formed is rotated, and sequentially passes through a development region (a region facing the developing roller), and a transfer region (a region facing the transfer roller) Q3.

The developing device G has the developing roller Ga to which a developing bias is applied; developing agent agitating members Gb, Gc, Gd for transporting developing agent to the developing roller Ga while agitating the same; and a developing agent container V for rotatably supporting the developing roller Ga and the developing agent agitating members Gb to Gd and for housing the developing agent. By means of the developing roller Ga, the developing device G develops the latent image on the image carrier PR passing through the developing region into a toner image.

Plural paper feed trays TR1 to TR4 (see FIGS. 1 and 2) for housing recording sheets to be transported to the transfer region Q3 are movably supported along pairs of rails RL1, RL1 disposed on the right and left sides of the paper feed trays TR1 to TR4 along the near-and-far direction (the direction perpendicular to the sheet plane in FIG. 2).

Recording sheets picked up by a pick-up roller Rp from the feed trays TR1 to TR4 are turned up one at a time by means of a turning-up roller Rs including a retard roller and a paper-feed roller. The sheet is transported by plural sheet transport rollers Ra disposed along a sheet transport path SH, and further transported to the transfer region Q3 at a predetermined timing by means of a registration roller Rr.

In addition, a recording sheet S fed from a manual paper feed tray TR0 is also transported to the transfer region Q3 by the sheet transport roller Ra and the registration roller Rr, both disposed along the sheet transport path SH. A sheet transport device (SH+Ra+Rr) is constituted of the sheet transport path SH, the sheet transport roller Ra, the registration roller Rr, and the like.

The transfer roller (transfer device) Rt to which a transfer bias is applied is disposed in the transfer region Q3. The transfer roller Rt contacts the image carrier PR in a pressing manner at the transfer region Q3. When a recording sheet passes through the transfer region Q3, a transfer bias (transfer voltage) is applied to the transfer roller Rt by the power source circuit E controlled by the controller C. At this time, the toner image on the image carrier PR is transferred to the recording sheet by way of the transfer roller Rt.

After the toner image on the surface of the image carrier PR is transferred to the recording sheet at the transfer region Q3, residual toner adhering onto the image carrier PR is collected by the cleaner CL (see FIG. 2). The image carrier PR, from which the residual toner adhering onto the surface thereof has been collected by the cleaner CL, is electrified by the electrifying roller CR again.

In FIG. 2, the recording sheet onto which a toner image which has not yet fixed and which has been transferred at the transfer region Q3 is transported to a fuser F disposed above the transfer roller Rt in a state where the toner image is not yet fixed.

As shown in FIG. 2, the fuser F has a pair of fixing members Fh, Fp constituted of a heating roller (heat-fixing member) Fh and a pressing roller (pressure-fixing member) Fp, which rotate while pressing each other. The fuser F is embodied as a unit, and is configured so as to be detachably attached to the image forming apparatus main body U1 as a fixation unit F.

The recording sheet S onto which the toner image has not yet been fixed and which has been transferred is transported to a fixation region Q4 formed by the heating roller Fh and the pressing roller Fp. The toner image is fixed by a nip region between the heating roller Fh and the pressing roller Fp.

In FIG. 2, the recording sheet, on which the fixed toner image is formed, is transported to the main body discharge roller (main body discharge member) R1 by being guided by a right sheet guide SG1, a left sheet guide SG2, and a discharge device switching gate (discharge switching gate) GT1; and discharged onto the sheet discharge tray TRh by the main body discharge roller R1. Incidentally, the left sheet guide SG2 is pivotally supported by a case of the fuser F, and under normal conditions is brought into contact with the right sheet guide SG1 under its own weight. At the time when the sheet transported from the fuser F passes between the sheet guides SG1 and SG2, the left sheet guide SG2 is pivoted upward upon receipt of force applied from the sheet being transported, whereby a transport path is formed between the right sheet guide SG1 and the left sheet guide SG2. Hence, the sheet is guided to the discharge roller R1. The discharge device switching gate GT1 is caused to move, by means of controlling an unillustrated discharge device switching gate motor (a stepping motor, or the like), between a main body tray discharge position for discharging a sheet onto the main body discharge tray TRh; a reversing device transport position from which a sheet is guided to the sheet-reversing device U3 at the time of double-sided printing; and an optional unit discharge position for transporting a sheet to the optional discharge unit U6, which will be described later. Meanwhile, the discharge device switching gate GT1 can be caused to move between the three positions without use of a motor, by means of plural solenoids and springs (see, e.g., JP-A-7-315668).

To the left of the paper delivery roller R1, there is provided a reverse path transport roller R2 for transporting a sheet to the sheet-reversing device U3 used at the time of double-sided printing. In a case where an image is recorded on both sides of a recording sheet in the image forming apparatus U shown in FIG. 2, when a rear end of a recording sheet on which an image has already been recorded on one side (i.e., an image has been already recorded on one side) is transported to the paper delivery roller R1, the paper delivery roller R1 is rotated in reverse to thus cause switch-back. The sheet is guided on the upper surface of the left sheet guide SG2 which has been pivoted to the right sheet guide SG1 side under on its own weight, thereby being transported to the reverse path transport roller R2. The sheet which has been transported to the reverse path transport roller R2 passes through a sheet reverse path SH1 formed inside the sheet-reversing device U3, and is sent back to the transfer region Q3 again in an inverted state, whereby an image is recorded on a second side (backside).

Figure 4:
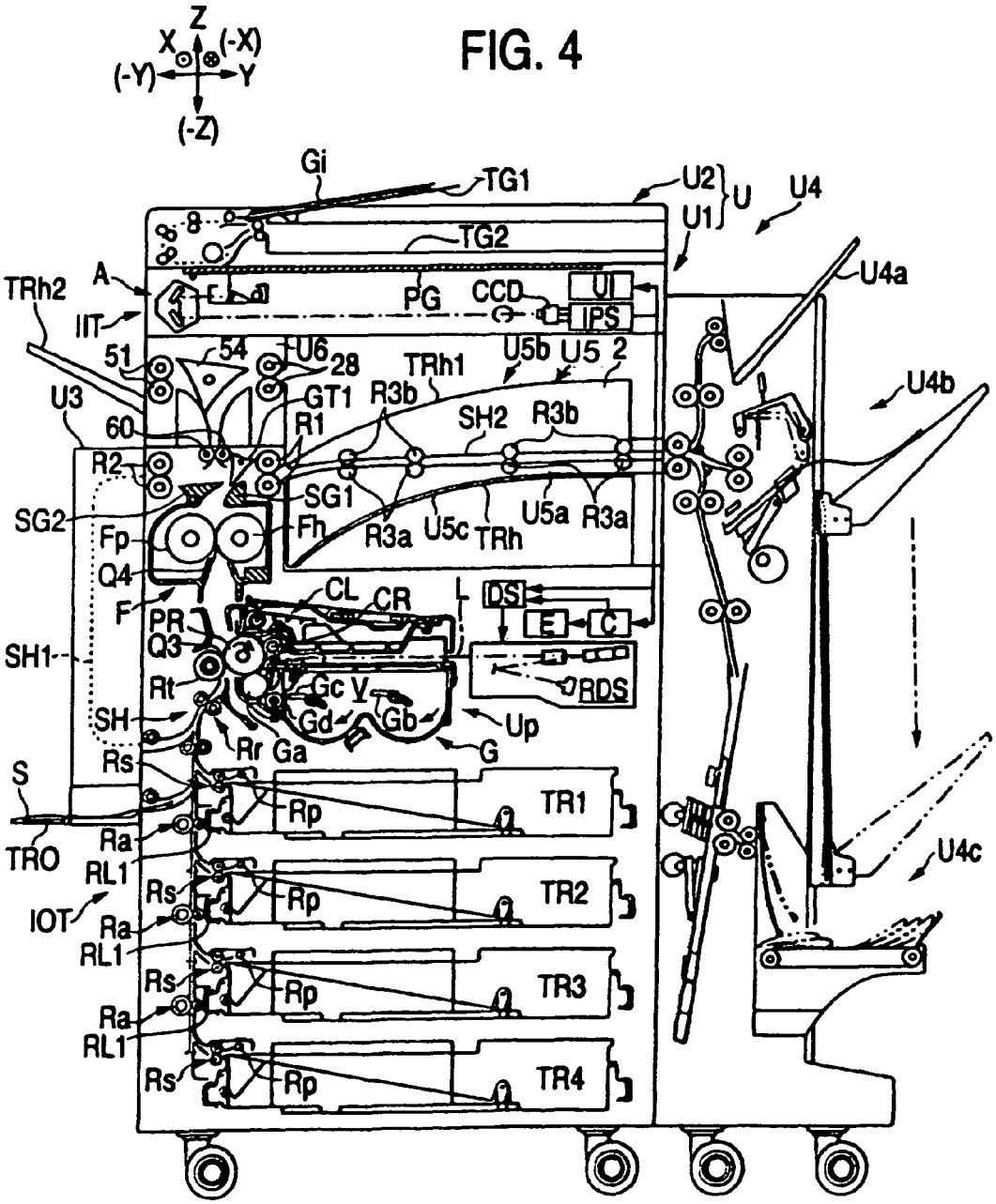
FIG. 4 is an explanatory view of the image forming apparatus onto which a sheet postprocessing device and the optional discharge unit are attached.

FIG. 4 is an explanatory view of the image forming apparatus to which a sheet postprocessing device and the optional discharge unit are attached. In FIG. 4, the finisher (the sheet postprocessing device) U4, the finisher transport device U5 for transporting a sheet discharged from the paper delivery roller R1 to the finisher U4, and the optional discharge unit (the optional discharge device) U6 can be additionally attached to the image forming apparatus U1 of the first embodiment.

The finisher U4 has a top tray U4*a*, an end-binding device U4*b*, and a saddle-binding device U4*c*. Onto the top tray U4*a*, a sheet which has been transported to the finisher U4 is discharged as is. The end-binding device U4*b* aligns plural sheets, and thereafter binds an end of the bundle of sheets. The saddle-binding device U4*c* aligns plural sheets, and thereafter binds the center of the bundle of sheets. Such a finisher (postprocessing device) U4 is conventionally known (see, e.g., JP-A-2003-89463), and detailed description thereof is omitted.

The finisher transport device U5 has a lower main body U5*a*, and an upper main body U5*b* supported on the lower main body U5*a*. A lower supported surface U5*c* of the lower main body U5*a* is supported on the upper surface of the main body discharge tray TRh. Plural lower finisher transport rollers R3*a* are rotatably supported on the upper surface of the lower main body U5*a*.

Upper finisher transport rollers R3*b* corresponding to the lower finisher transport rollers R3*a* are rotatably supported on the lower surface of the upper main body U5*b*. Accordingly, the finisher transport path SH2 is formed between the lower main body U5*a* and the upper main body U5*b*. A sheet which has been transported to the finisher transport path SH2 by the main body discharge roller R1 is transported to the finisher U4 by the pairs of upper and lower finisher transport rollers R3*a*, R3*b*.

An optional face-down tray (the optional discharge tray) TRh1 on which sheets are placed is formed on the upper surface of the upper main body U5*b*. Onto the optional face-down tray TRh1 of the first embodiment, a sheet is discharged in a face-down state where the image-recorded face of the sheet is on the underside.

Meanwhile, the image forming apparatus U of the first embodiment is provided with the finisher U4. However, in a case where the finisher U4 is not provided and instead an optional discharge unit, which will be described later, is provided, the following configuration is also applicable. The image forming apparatus U has solely the optional face-down tray TRh1; and the optional discharge tray unit from which the finisher transport rollers R3*a*, R3*b*, or the finisher transport path SH2 are eliminated is detachably attached thereto.

Figure 5:
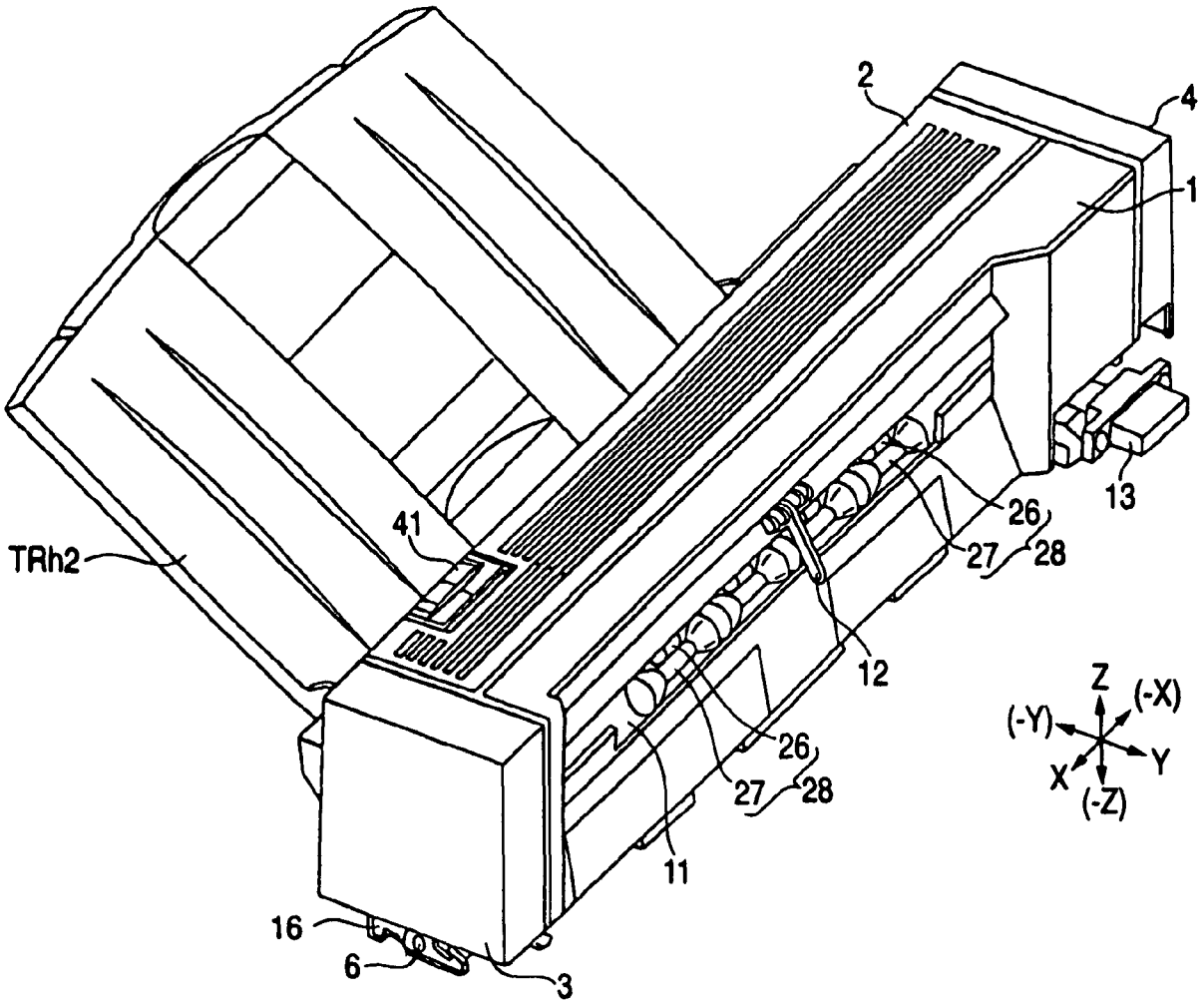
FIG. 5 is a perspective explanatory view of the optional discharge unit to which a face-up tray is attached, as viewed from a face-down tray.

FIG. 5 is a perspective explanatory view of the optional discharge unit, to which a face-up tray is attached, as viewed from the face-down tray.

Figure 6A:
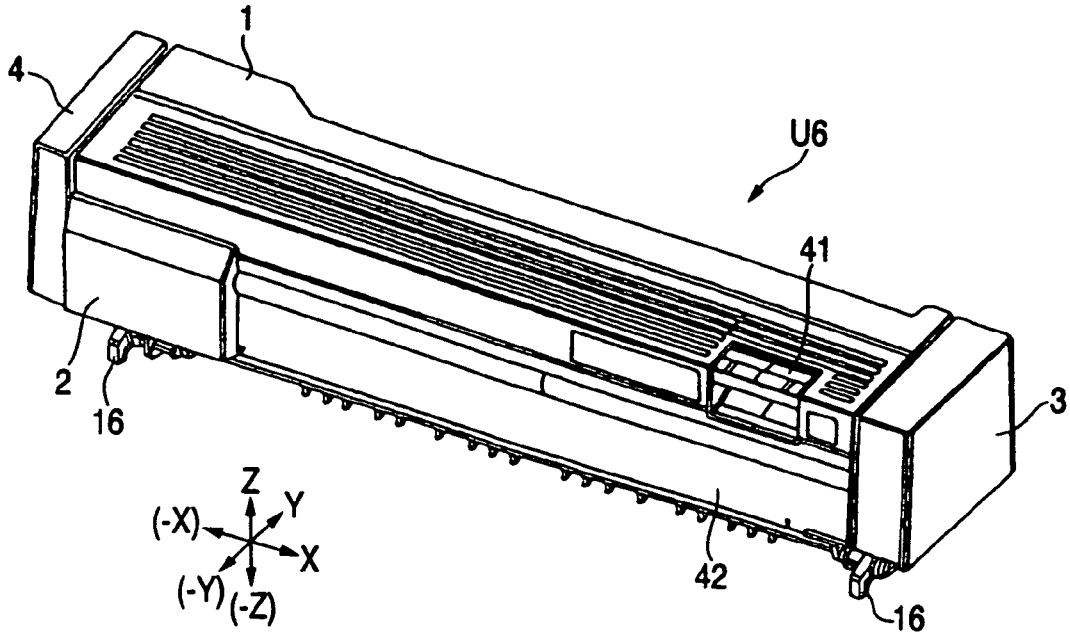
Figure 6B:
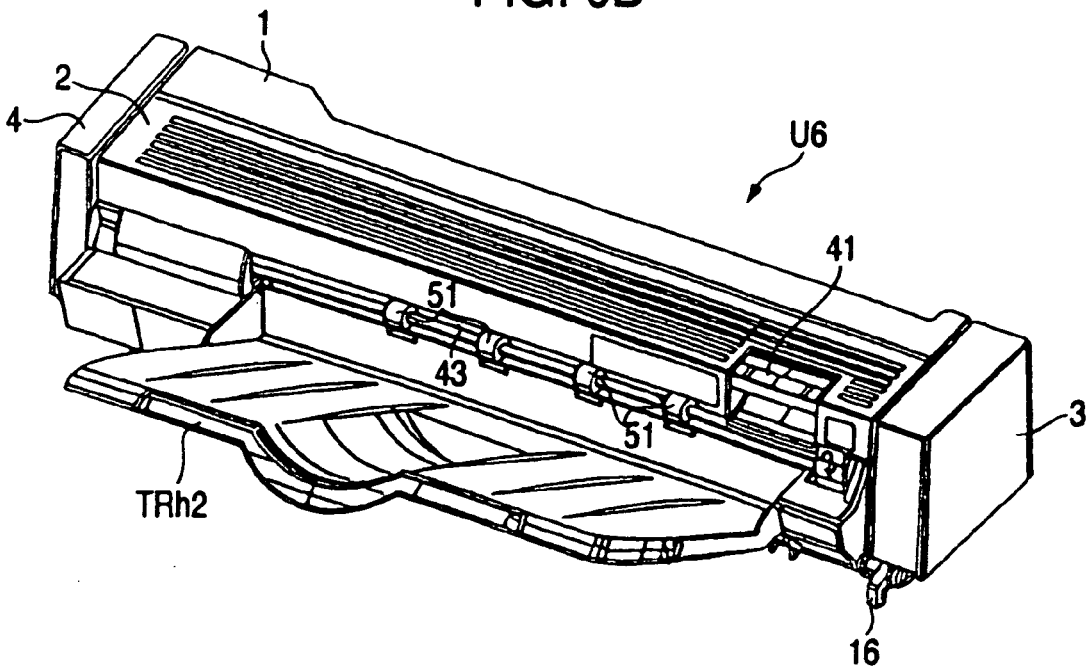

FIGS. 6A and 6B are perspective explanatory views of the optional discharge unit as viewed from the face-up tray. FIG. 6A is a perspective explanatory view of a state where the face-up tray is not attached. FIG. 6B is a perspective explanatory view of a state where the face-up tray is attached.

Figure 7:
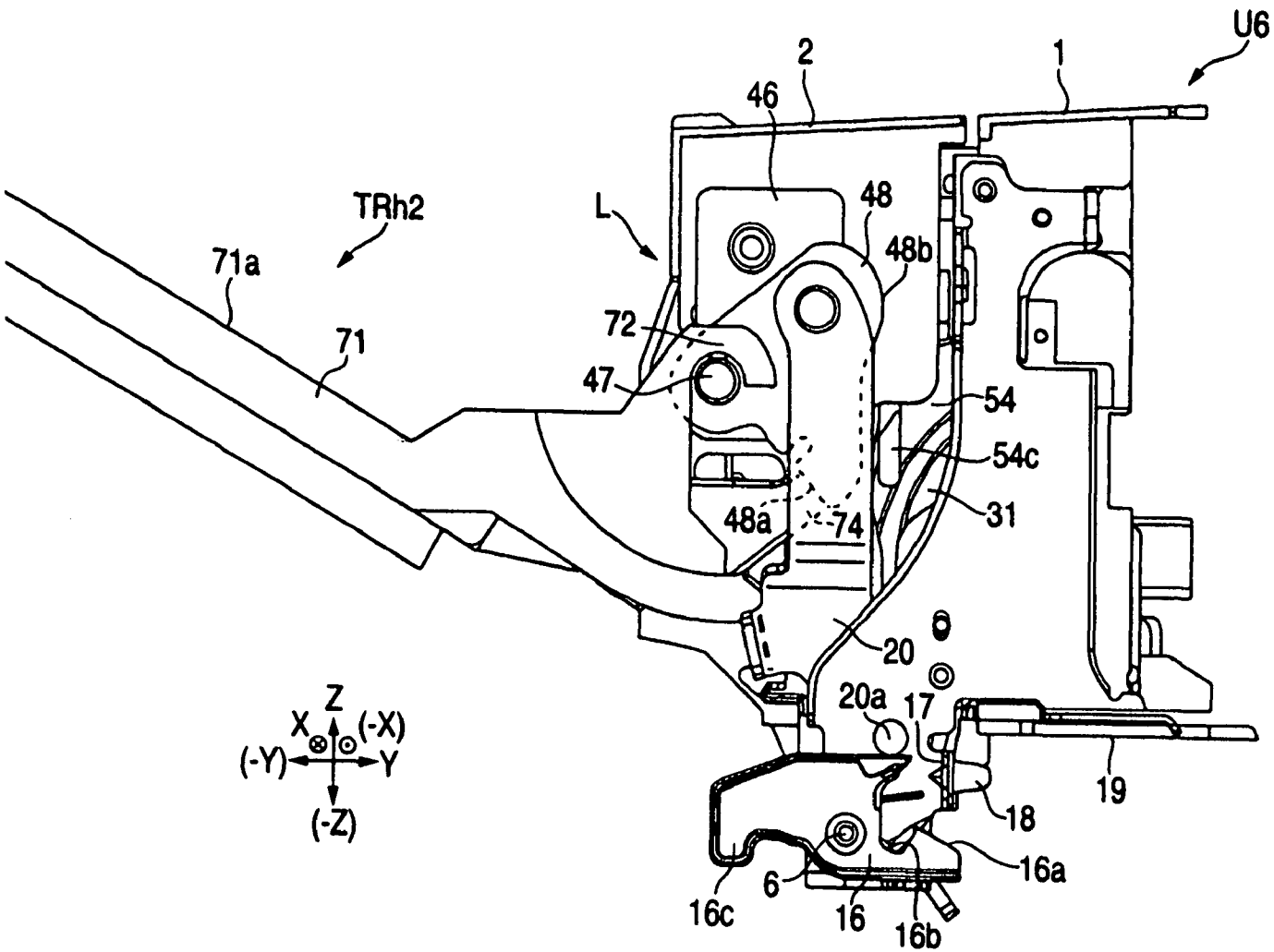
FIG. 7 is a front end view of the optional discharge unit.

FIG. 7 is a front end view of the optional discharge unit.

Figure 8:
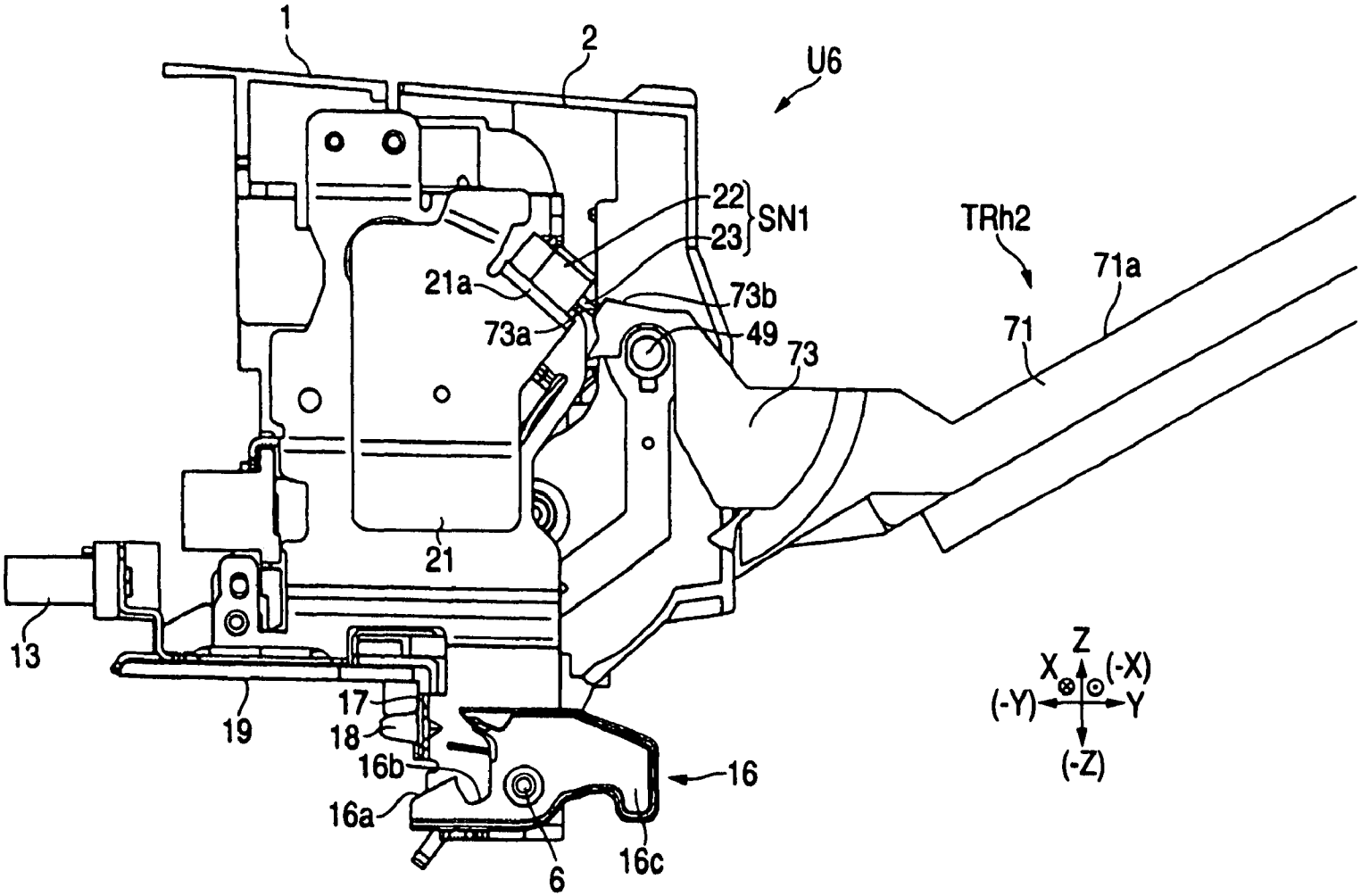
FIG. 8 is a rear end view of the optional discharge unit.

FIG. 8 is a rear end view of the optional discharge unit.

Figure 9A:
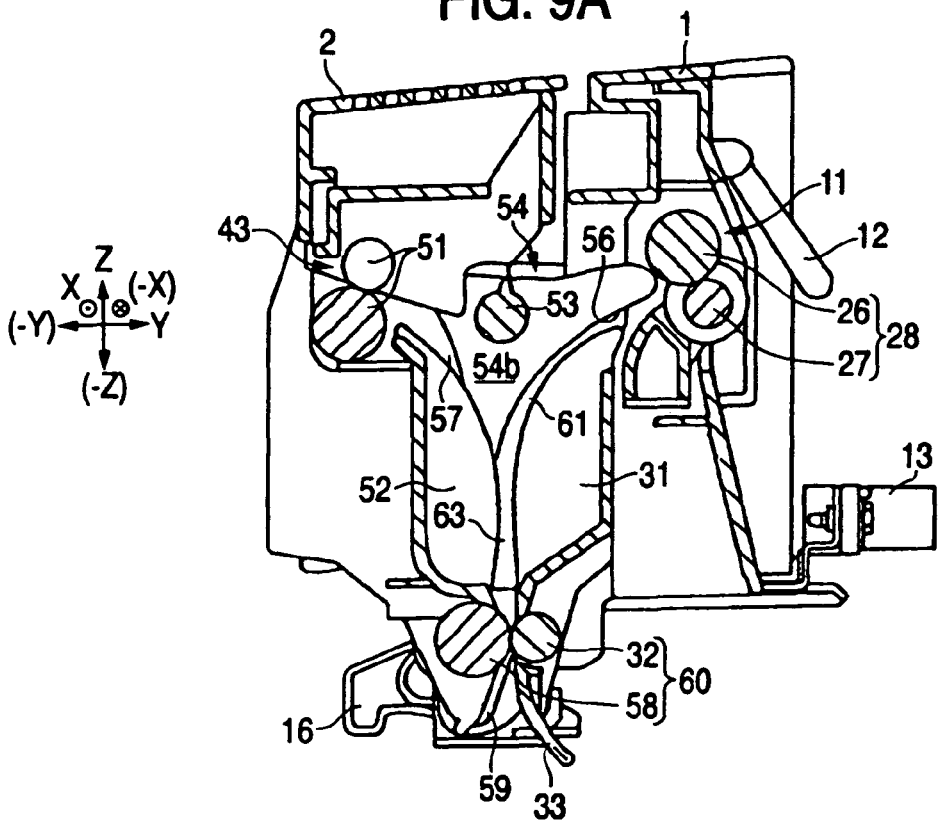
Figure 9B:
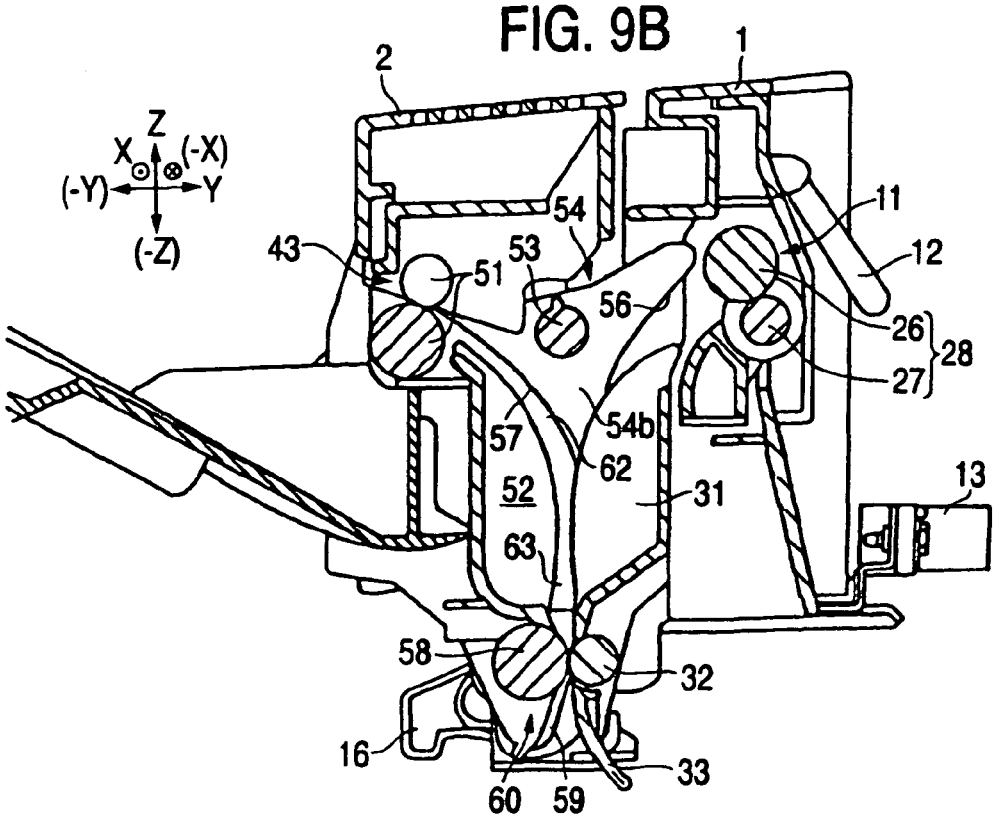

FIGS. 9A and 9B are cross-sectional explanatory views of an essential portion of the optional discharge unit. FIG. 9A is a cross-sectional explanatory view of the essential portion in a state where the face-up tray is not attached. FIG. 9B is cross-sectional explanatory view of the essential portion in a state where the face-up tray is attached.

Figure 10:
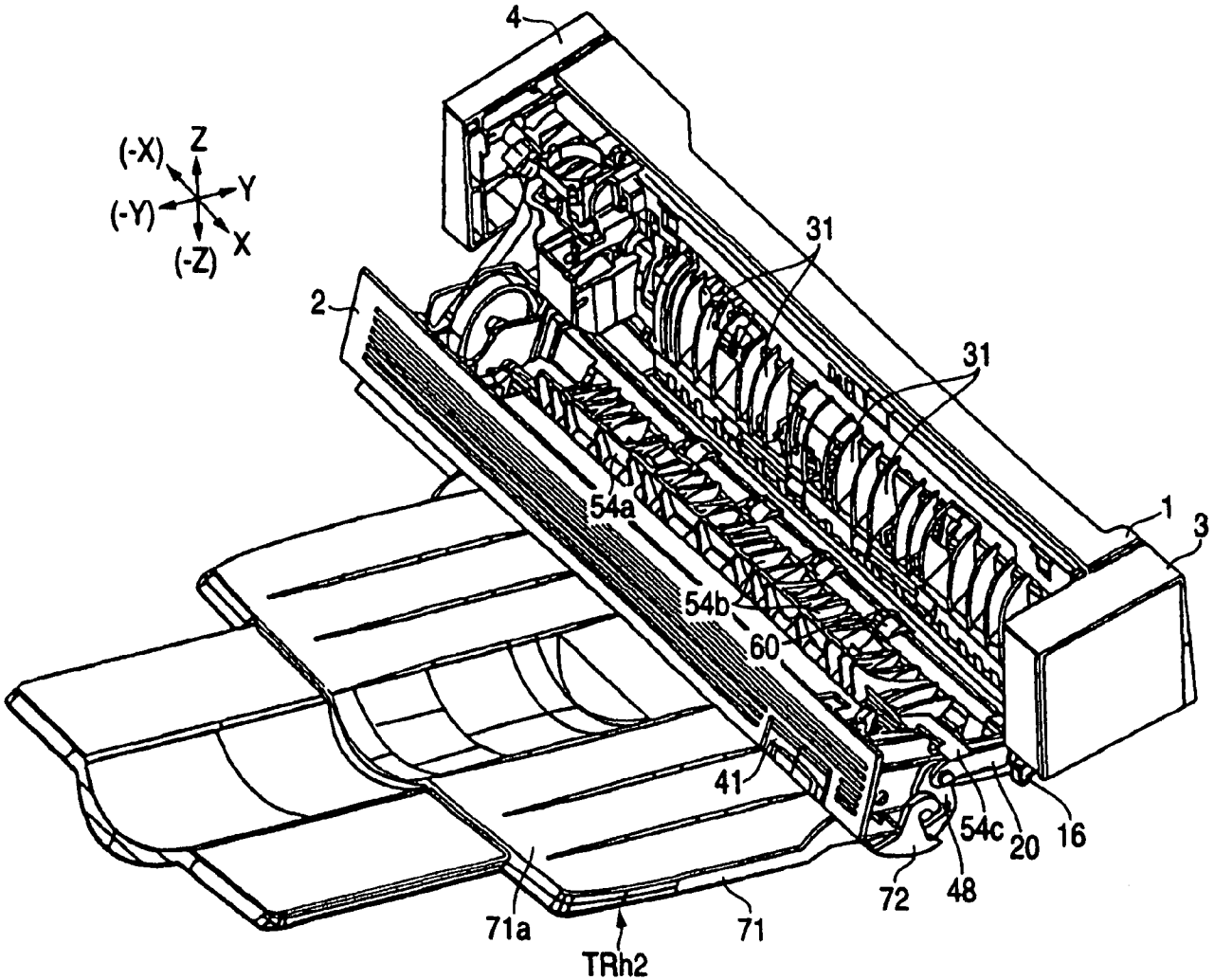
FIG. 10 is a perspective explanatory view of the optional discharge unit with the upper end thereof open.

FIG. 10 is a perspective explanatory view of the optional discharge unit with the upper end thereof open.

Figure 11:
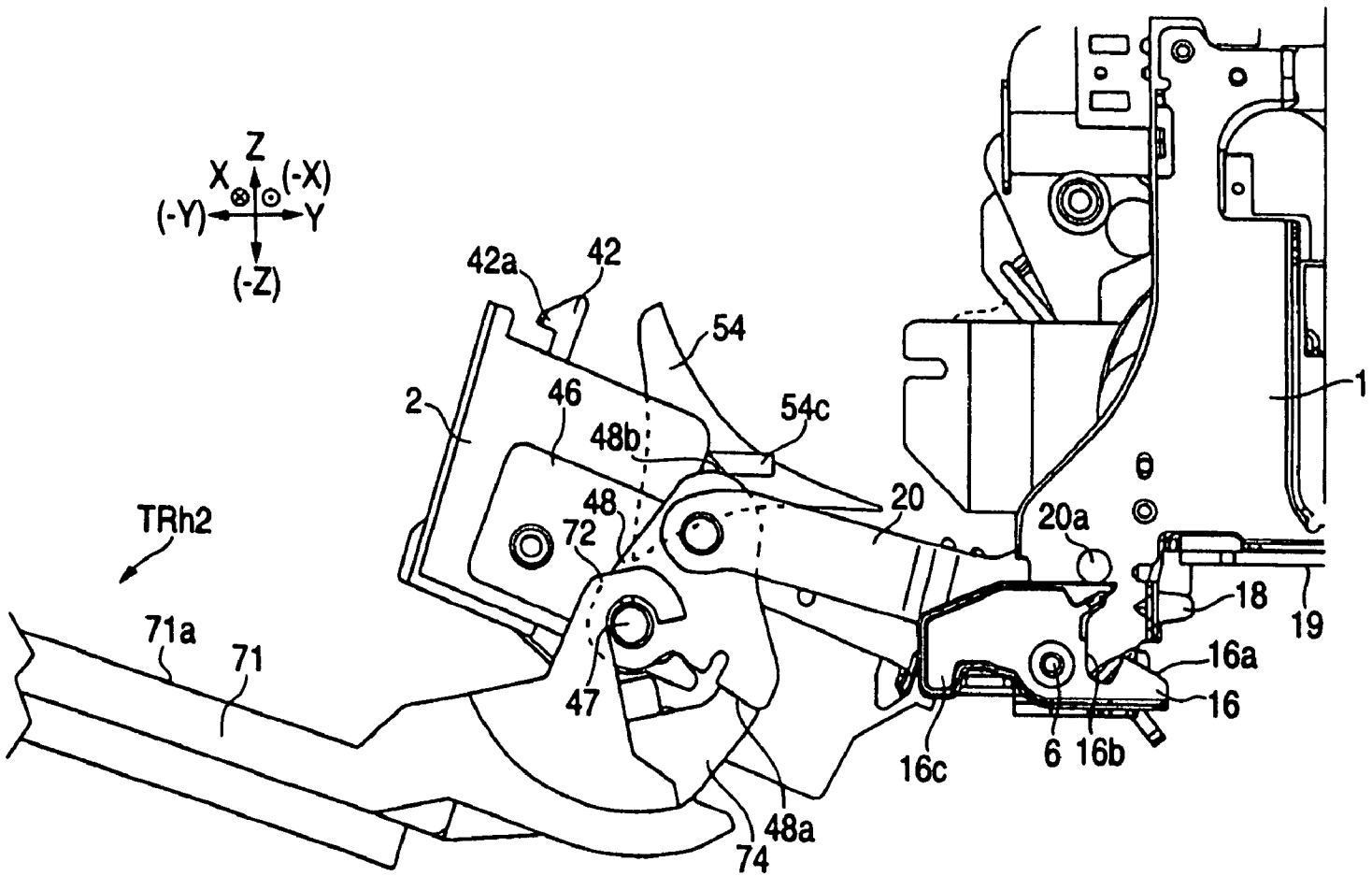
FIG. 11 is a front end view of the optional discharge unit with the upper end thereof open, and is a view corresponding to FIG. 7.

FIG. 11 is a front end view of the optional discharge unit with the upper end thereof open, and is a view corresponding to FIG. 7.

Figure 12:
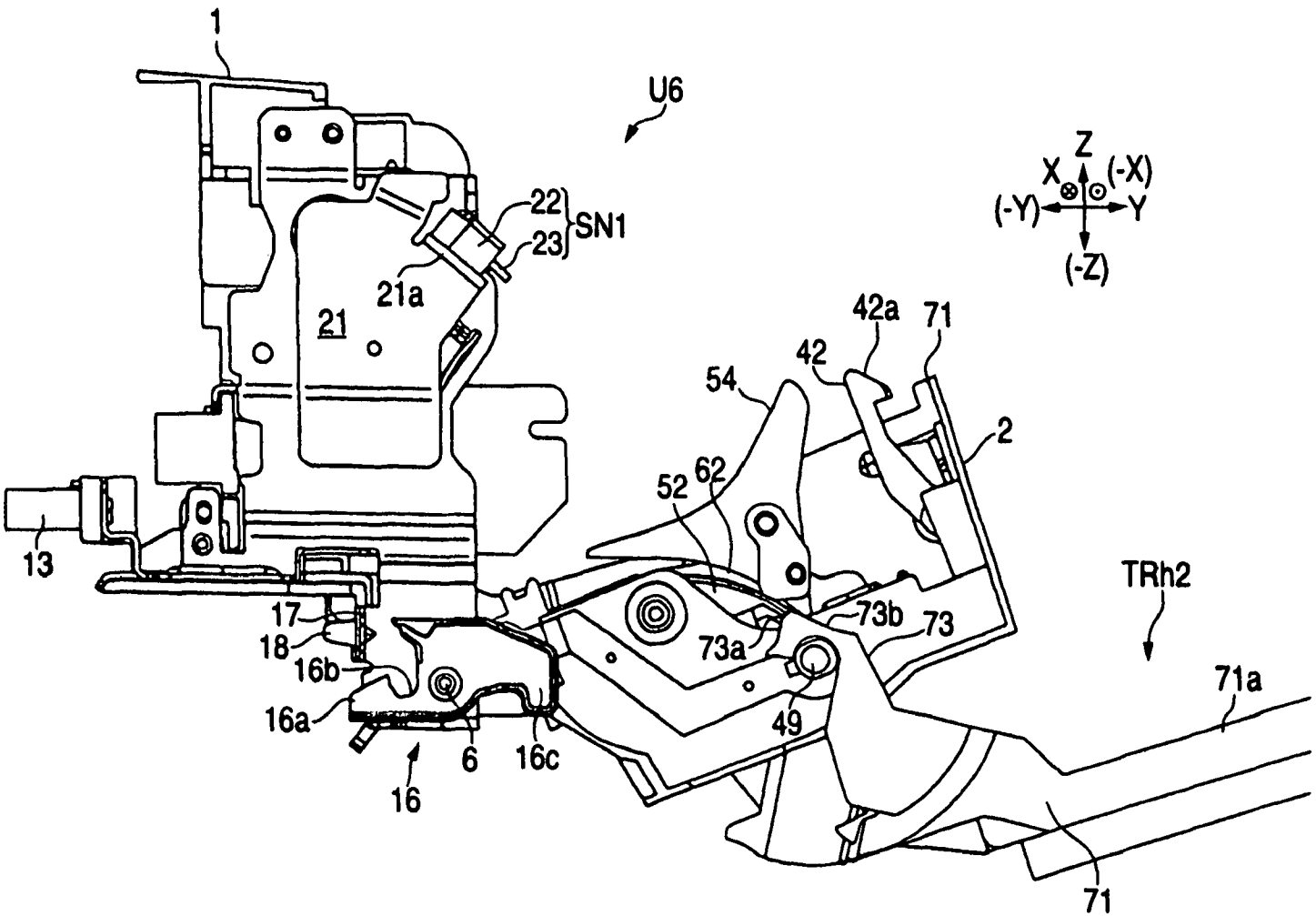
FIG. 12 is a rear end view of the optional discharge unit with the upper end thereof open, and is a view corresponding to FIG. 8.

FIG. 12 is a rear end view of the optional discharge unit with the upper end thereof open, and is a view corresponding to FIG. 8.

Figure 13:
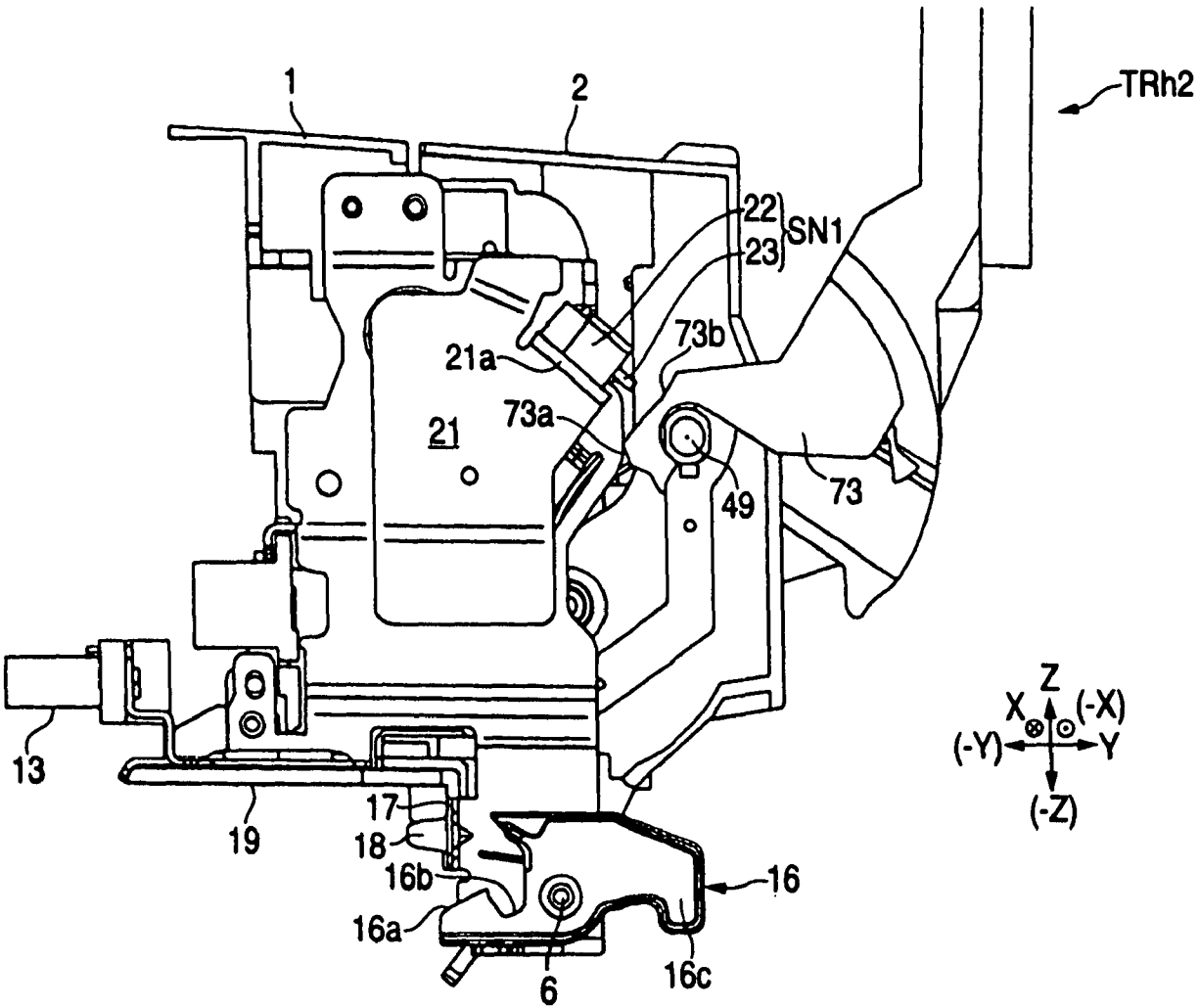
FIG. 13 is a rear end view of the optional discharge unit with the optional face-up tray pivoted upward, and is a view corresponding to FIG. 8.

FIG. 13 is a rear end view of the optional discharge unit with the optional face-up tray pivoted upward, and is a view corresponding to FIG. 8.

In FIGS. 5 to 12, the optional discharge unit U6 to be attached to the image forming apparatus main body U1 has a face-down-side case 1 on the right, a face-up-side case 2 on the left, a front cover 3, and a rear cover 4. The lower end of the face-down-side case 1 and the lower end of the face-up-side case 2 are connected by means of a pair consisting of a front hinge axis 6 and a rear hinge axis 6 (see FIGS. 7 and 8). Accordingly, the upper end of the face-down-side case 1 and the upper end of the face-up-side case 2 are configured to be reclosable with each other between a state where a case is closed as shown in FIGS. 5 to 9B and a state where a case is open as shown in FIGS. 10 to 12. Meanwhile, in the optional discharge unit U6 of the first embodiment, when the upper ends of the cases 1, 2 are opened in a state where the optional discharge unit U6 is attached to the image forming apparatus main body U1, the face-down-side case 1 serves as a stationary section supported by the image forming apparatus main body U1, and the face-up-side case 2 serves as a pivot section pivoting in relation to the face-down-side case 1. The front cover 3 is detachably attached to the front end of the face-down-side case 1, and the rear cover 4 is detachably attached to the rear end of the same.

(Descriptions of Face-Down-Side Case 1)

As shown in FIG. 5, a face-down discharge port 11 is formed on the right end face (end face in the +Y direction) of the face-down-side case 1. A tray-full detection sensor 12 is disposed above the center in the longitudinal direction of the face-down discharge port 11. The tray-full detection sensor 12 is a conventionally known sensor for detecting whether or not the optional face-down tray TRh1 is full with bundles of sheets discharged onto the optional face-down tray TRh1. An optional-device-side connector 13 protruding rightward is disposed at the rear (−X side portion) of the face-down-side case 1.

As shown in FIGS. 7, 8, 11, and 12, mounting lock members 16 which are pivotable about the hinge axes 6 are supported on the front and rear end faces of the lower left end (−Z end on the −Y side) of the face-down-side case 1. Each of the mounting lock members 16 has a tiltable abutment face 16*a*, which is abutted and tilted when being mounted, formed on the right end (+Y end); a pin-engagement-for-mount section 16*b* which is engaged when being mounted and disposed on the left side (−Y side) of the tiltable abutment face 16*a*; and a lock releasing operation section 16*c*. Under normal conditions, the mounting lock member 16 is retained in a state shown in FIGS. 7 and 8, by means of an unillustrated torsion spring.

In FIGS. 7, 8, 11, and 12, pin support sections 17, 17 are formed integrally with the face-down-side case 1 to the right of the mounting lock member 16. Mount-positioning pins 18, 18 protruding rightward (+Y side) are fixedly supported on the pin support sections 17, 17.

A supported surface 19, which is supported on the upper surface of the image forming apparatus main body U1 when being attached thereto, is formed on the right lower end face of the face-down-side case 1.

As shown in FIGS. 7 and 11, a plate support arm (angle-retaining-member support arm) 20 is supported rotatably about an arm rotation axis 20*a* above the hinge axis 6 of the face-down-side case 1.

As shown in FIGS. 8, 12, and 13, a sensor support member 21 is supported on the rear end face of the face-down-side case 1. A sensor-support bent section 21*a* which is bent rearward is formed integrally on the left end (−Y end) of the sensor support member 21. A tray detection sensor SN1 is supported on the sensor-support bent section 21*a*. The tray detection sensor SN1 has a sensor main body 22, and a tray detection bar 23 that can be projected and retracted in relation to the sensor main body 22.

As shown in FIGS. 5, 9A, and 9B, a face-down discharge roller (optional discharge member, a face-down discharge member) 28 which includes a drive roller 26 which rotates, and a corrugation roller 27 opposing and abutted with the drive roller 26 is disposed at the face-down discharge port 11. The drive roller 26 rotates forward for discharging a sheet to the optional face-down tray TRh1; and rotates in reverse for transporting a sheet to the sheet-reversing device U3 side at the time of double-sided printing. The corrugation roller 27 is a conventionally known roller which curls a sheet to be discharged to the optional face-down tray TRh1 to thus impart tension thereto for the purpose of enhancing linearity of the sheet (see, e.g., JA-A-8-208091), and detailed description thereof is omitted. The face-down discharge roller 28 of the first embodiment has an offset discharge function of discharging a sheet onto the optional face-down tray TRh1 while displacing (offsetting) the sheet in its width direction. A configuration for performing the offset discharging is conventionally known (see, e.g., JP-A-8-208098), and detailed description thereof is omitted.

In FIGS. 9A to 10, on the left (a portion on the −Y side) of the face-down-side case 1, plural face-down sheet guides 31 arranged side-by-side in the longitudinal direction are integrally supported on the face-down-side case 1. In FIGS. 9A and 9B, a common-transport-path driven roller 32 is disposed below the face-down sheet guide 31. A right common-transport-path sheet guide 33 is supported on the face-down-side case 1 below the common-transport-path driven roller 32. The common-transport-path driven roller 32 rotates forward when transporting a sheet upward (in the +Z direction); and rotates in reverse when transporting a sheet downward (in the −Z direction).

(Descriptions of Face-Up-Side Case 2)

In FIGS. 5 to 8, a case-opening-operation section 41 is disposed on the upper front end of the face-up-side case 2. In FIGS. 11 and 12, a case-engagement member 42 including an engagement claw 42*a* is connected to the case-opening-operation section 41. Under normal conditions, the case engagement member 42 is fitted in an unillustrated engagement member fitting hole, thereby being maintained in case-closed state shown in FIGS. 5 to 9B. When a user operates the case-opening-operation section 41, the case engagement member 42 is pivoted, thereby releasing engagement with the engagement member fitting hole (not shown). At this time, the face-up-side case 2 pivots about the hinge axis 6 in relation to the face-down-side case 1, whereby the upper end of the face-up-side case 2 is opened in relation to the upper end of the face-down-side case 1.

In FIGS. 6A and 6B, when an optional face-up tray TRh2 (see FIG. 6B) is not attached to the optional discharge unit U6, a discharge port sealing cover 42 is attached to the left end face (−Y end face). In FIG. 6B, when the optional face-up tray TRh2 is attached to the optional discharge unit U6, the discharge port sealing cover 42 is removed. When the discharge port sealing cover 42 is removed, a face-up discharge port 43 formed on the left end face of the face-up-side case 2 is exposed.

In FIGS. 7 and 11, a tray support plate (face-up tray support member) 46 is supported on the front end of the face-up-side case 2. A front tray support axis (face-up tray support member) 47 is fixedly supported on the tray support plate 46. The optional face-up tray (optional discharge tray) TRh2 is attached to the tray support axis 47, and a lower left portion of a tray-angle-retaining plate (placement-face-angle-retaining member) 48 is rotatably supported on the same. The upper right portion of the tray-angle-retaining plate 48 is rotatably supported on the plate support arm 20, which is rotatably supported on the face-down-side case 1. A tray engagement face 48*a* (see FIGS. 7 and 11) is formed on the lower portion of the tray-angle-retaining plate 48. A gate-position-retaining engagement section 48*b* is formed on the upper right edge of the tray-angle-retaining plate 48.

Therefore, even when the face-up-side case 2 is opened or closed in relation to the face-down-side case 1, the tray-angle-retaining plate 48 is retained in a predetermined posture by the tray support plate 46 and the plate support arm 20 throughout the opening and closing operation.

The tray support plate 46, the front tray support axis 47, the tray-angle-retaining plate 48, the plate support arm 20, and the like, form a placement-face-angle-retaining link mechanism L.

In FIGS. 8 and 12, a rear tray support axis (face-up tray support member) 49 is fixedly supported on the rear end of the face-up-side case 2.

In FIGS. 6B, 9A, and 9B, a face-up discharge roller (optional discharge member, face-up discharge member) 51 having a drive roller and a driven roller is rotatably supported on the face-up discharge port 43. In FIGS. 9A to 10, to the lower right of the face-up discharge roller 51, plural face-up sheet guides 52 and a tray-switching gate (a transport path switching gate) 54 are disposed. The plural face-up sheet guides 52 are arranged in the front-and-rear direction (in the X-axis direction) and are integrally supported on the face-up-side case 2. The tray-switching gate 54 is rotatably supported on the face-up-side case 2 about a rotation axis 53. In FIGS. 9A and 9B, the tray-switching gate 54 extends in the front-and-rear direction, and includes a bridge section 54*a*, plural gate main bodies 54*b*, and an engaged-when-open section 54*c*. The bridge section 54*a* (see FIG. 10) is rotatably supported on the rotation axis 53 at the front and rear ends. The plural gate main bodies 54*b* are of a substantially triangular shape, arranged in the front-and-rear direction, and integrally joined to the bridge section 54*a*. The engaged-when-open section 54*c* is formed in such a manner as to protrude farther than the front end of the bridge section 54*a* (see FIGS. 7, 10, and 11).

In FIGS. 9A and 9B, the gate main body 54*b* has a right face-down guide face 56 and a left face-up guide face 57. An unillustrated solenoid and a spring are joined to the tray-switching gate 54. The gate main body 54*b* is configured to be movable, through on-and-off control of the solenoid, between a face-down tray discharge position (the position shown in FIG. 9A), which is a position for discharging a sheet onto the face-down tray TRh1, and a face-up tray discharge position (the position shown in FIG. 9B), which is a position for discharging a sheet onto the face-up tray TRh2. A configuration for rotating the tray-switching gate 54 by a solenoid or the like is conventionally known (see, e.g., JP-A-7-315668), and detailed description thereof is omitted.

Below the face-up sheet guide 52, in FIGS. 9A to 10, a common-transport-path drive roller 58 which is opposed to and abutted with the common transport path driven roller 32 is supported on the face-up-side case 2. A left common-transport-path sheet guide 59 is supported on the face-up-side case 2 below the common-transport-path driven roller 58. The common-transport-path driven roller 32 and the common-transport-path drive roller 58 constitute a common-transport-path transport roller 60.

Therefore, in a state where the tray-switching gate 54 is moved to the face-down discharge position (the position shown in FIG. 9A), a face-down transport path (the optional transport path) 61 is formed between the face-down guide face 56 and the face-down sheet guide 31. In addition, in a state where the tray-switching gate 54 is moved to the face-up discharge position (the position shown in FIG. 9B), a face-up transport path (an optional transport path) 62 is formed between the face-up guide face 57 and the face-up sheet guide 52. Furthermore, a common transport path (the optional transport path) 63 is formed between the lower portion of the face-down sheet guide 31 and the lower portion of the face-up sheet guide 52, and between the common transport path sheet guides 33, 59. Accordingly, when the tray-switching gate 54 is moved to the face-down discharge position or to the face-up discharge position, a sheet which has been transported upward through the common transport path 63 by the common transport path transport rollers 60 is discharged to the optional face-down tray TRh1 or to the optional face-up tray TRh2.

Incidentally, in FIG. 7, the optional discharge unit U6 of the first embodiment is configured such that in a state where the face-down-side case 1 and the face-up-side case 2 are closed (the state shown in FIG. 7), the engaged-when-open section 54*c* does not abut the plate support arm 20. Therefore, the tray-switching gate 54 is allowed to move between the face-down discharge position and the face-up discharge position. Meanwhile, in FIGS. 10 and 11, in a state where the upper end of the face-up-side case 2 is opened in relation to the upper end of the face-down-side case 1 (the state shown in FIGS. 10 and 11), the engaged-when-open section 54*c* is engaged with the gate-position-retaining engagement section 48*b* of the tray-angle-retaining plate 48. In addition, in this state, the tray-switching gate 54 is configured so as to be retained at the face-up discharge position (the position shown in FIG. 9B).

(Description of the Optional Face-Up Tray TRh2)

In FIGS. 7, 8, and 10 to 12, the optional face-up tray TRh2 includes a face-up tray main body 71 which has on the upper face thereof a sheet-receiving face 71*a*, on which a sheet discharged from the face-up discharge port 43 is placed. A front supported section (a support member engagement section) 72 and a rear supported section (a support member engagement section) 73, which are substantially arc-shaped, are formed integrally on the front and rear ends of the face-up tray main body 71. The front supported section 72 is rotatably supported by the front tray support axis 47. The rear supported section 73 is rotatably supported by the rear tray support axis 49. Therefore, the optional face-up tray TRh2 is detachably attached about the tray support axes 47, 49.

Below the front supported section 72, as shown in FIGS. 7 and 11, a placement-face-angle-setting section 74 is formed integrally with the face-up tray main body 71. When the optional face-up tray TRh2 is attached to the optional discharge unit U6, a front end (upper end portion) of the placement-face-angle-setting section 74 abuts the tray engagement face 48*a* of the tray-angle-retaining plate 48, thereby being engaged. As a result of the engagement between the placement-face-angle-setting section 74 and the tray engagement face 48*a*, the sheet placement face 71*a* is retained at a predetermined angle upwardly inclined from the horizontal (see FIG. 7). In addition, in a state where the face-up-side case 2 is open in relation to the face-down-side case 1 (see FIG. 11), the tray-angle-retaining plate 48 is retained at a predetermined posture by means of the placement-face-angle-retaining link mechanism L. Accordingly, a tilt angle of the sheet placement face 71*a* in relation to the horizontal is changed little when compared with the posture before the face-up-side case 2 is opened.

In FIGS. 8, 12, and 13, a detection-bar-abutting section 73*a* is formed on the upper right end (edge in the +Y+Z direction) of the rear supported section 73. On the upper edge of the rear supported section 73 which is adjacent to the detection-bar-abutting section 73*a* in the left direction (in the −Y direction) thereof, a detection-bar abutment section 73*b* is formed.

Accordingly, in a state where the face-up-side case 2 is closed in relation to the face-down-side case 1 (the state shown in FIG. 8), the tray detection bar 23 abuts the detection abutting section 73*a*. In this case, the tray detection bar 23 is housed in the sensor main body 22, thereby turning on the detection switch therein. As a result, the tray detection sensor SN1 detects that the optional face-up tray TRh2 is attached in a state where a sheet can be discharged thereon.

Meanwhile, in a state where the face-up-side case 2 is open in relation to the face-down-side case 1 (the state shown in FIG. 12), or a state where the front end of the optional face-up tray TRh2 is pivoted upward (the state shown in FIG. 13), the tray detection bar 23 opposes the detection abutted section 73*b*, and does not abut the same. In addition, in a case where the optional face-up tray TRh2 is not attached, no member for abutting the tray detection bar 23 is present. In these cases, the tray detection sensor SN1 detects that a sheet cannot be discharged onto the optional face-up tray TRh2.

(Description of Mounting of Optional Discharge Unit U6 to Image forming Apparatus Main Body U1)

In FIGS. 3A to 3C, when the optional discharge unit U6 is attached to the image forming apparatus main body U1, first, the front cover 3 and the rear cover 4, both belonging to the optional discharge unit U6, are removed. The optional discharge unit U6 is caused to approach the image forming apparatus main body U1 from which the top cover U1*a* is removed. The optional discharge unit lock pins U18, U19 are caused to abut the tiltable abutment face 16*a* of the mounting lock member 16. The mount-positioning pins 18, 18 are caused to oppose the optional discharge unit positioning holes U16, U17, respectively. When the optional discharge unit U6 is pressed rightward (in the +Y direction) in this state, the optional discharge unit lock pins U18, U19 are pressed in while abutting the tiltable abutment face 16*a*. Accordingly, the right end portion (+Y end) of the mounting lock member 16 is pivoted downward by the elastic restoration force of the torsion spring. When the optional discharge unit lock pins U18, U19 are completely pressed in, the mount-positioning pins 18, 18 fit in the optional discharge unit positioning holes U16, U17; the optional discharge unit lock pins U18, U19 fit in the pin-engagement-for-mount section 16*b*; and the mounting lock member 16 returns to its normal position by the force of the torsion spring.

Therefore, in this state, the optional discharge unit U6 is attached to the image forming apparatus main body U1 in a state of being positioned by the mount-positioning pins 18, 18 and the optional discharge unit positioning holes U16, U17; and is locked so as to be immobile by means of the optional discharge unit lock pins U18, U19 and the pin-engagement-for-mount section 16*b*. Incidentally, the optional-device-side connector 13 and the main-body-side connector U11 constitute a drawer connector. When the optional discharge unit U6 is attached to the image forming apparatus main body U1, the optional-device-side connector 13 is attached to the main-body-side connector U11. Accordingly, the optional discharge unit U6 and the image forming apparatus U1 are electrically connected, and control signals and electric current from the image forming apparatus U1 are transmitted by way of the connectors U11, 13.

(Descriptions of Control Section of First Embodiment)

Figure 14:
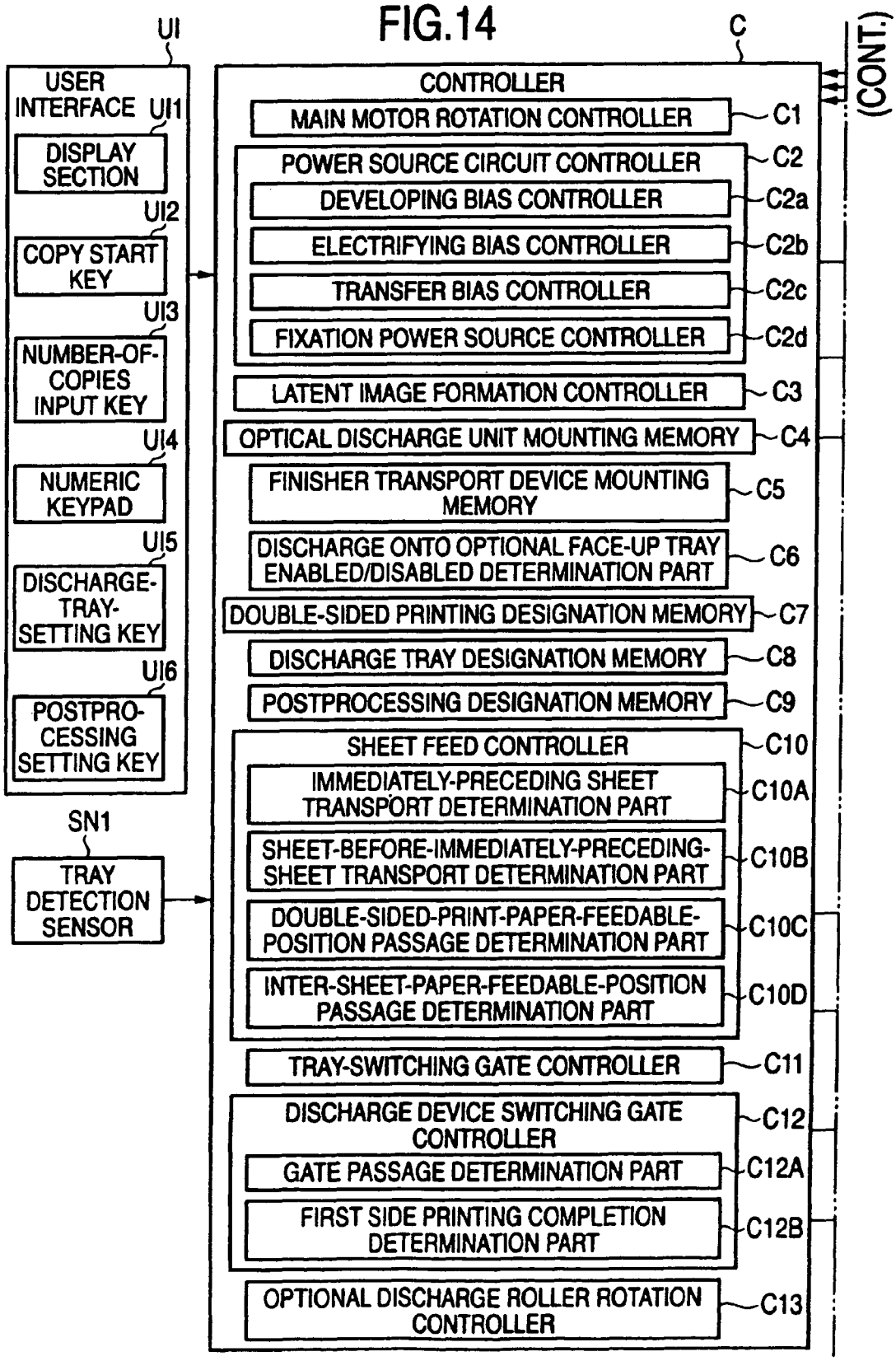
FIG. 14 is a block diagram (functional block diagram) showing respective functions provided with a control section of the image forming apparatus of the first embodiment.

FIG. 14 is a block diagram (functional block diagram) showing respective functions provided by control sections of the image forming apparatus of the first embodiment.

In FIG. 14, the controller C is constituted of a microcomputer including an I/O (input/output interface) for performing input/output of a signal to/from the outside and for adjusting an input/output signal level, and the like; ROM (read only memory) in which programs, data, and the like for executing necessary processing are stored; RAM (random access memory) for storing necessary data temporarily; a CPU (central processing unit) for executing processing in accordance with programs stored in the ROM; a clock generator; and the like. By means of executing the programs stored in the ROM, a variety of functions can be performed.

(Signal Input Elements Connected to Controller C)

Output signals from the following signal output elements U1, SN1 are input in the controller C:

UI: User Interface

The user interface UI includes a display section UI1, a copy start key UI2, a number-of-copies input key UI3, a numeric keypad UI4, a double-sided-printing selection key UI5, a discharge-tray-setting key UI6, a postprocessing setting key UI7, and the like.

SN1: Tray Detection Sensor

The tray detection sensor SN1 detects whether or not the optional face-up tray TRh2 is attached in a state where a sheet can be discharged thereto.

(Controlled Elements Connected to Controller C)

The controller C outputs control signals of the following controlled elements:

CG: Document Transport Device Controller

The document transport device controller CG is a controller incorporated in the automatic document transport device U2, and controls operations of the automatic document transport device U2 in accordance with control signals output from the controller C of the image forming apparatus main body U1.

CI: Image Scanner Controller

The image scanner controller CI is a controller incorporated in an image scanner (an image-reading section; that is, an IIT), and controls operations of the IIT in accordance with control signals output from the controller C of the image forming apparatus main body U1.

CA: Postprocessing Device Controller

The postprocessing device controller CA is a controller incorporated in the finisher (postprocessing device) U4, and controls operations of the finisher U4 in accordance with control signals output from the controller C of the image forming apparatus main body U1.

DL: Laser Drive Circuit

The laser drive circuit DL forms a latent image on the surface of the photosensitive member PR by means of driving a laser diode (not shown) of the ROS (latent image forming device).

D1: Main Motor Drive Circuit

The main motor drive circuit D1 drives a main motor M, which rotates the photosensitive member PR, the developing roller Ga of the developing device G (see FIG. 2), and the like, by way of unillustrated gears.

E: Power Source Circuit

The power source circuit E has the following power source circuits.

E1: Developing-Bias Power Source Circuit

The developing-bias power source circuit E1 applies a developing bias onto the developing roller Ga of the developing device G.

E2: Electrification Power Source Circuit

The electrification power source circuit E2 applies an electrifying bias onto the electrifying roller CR (see FIG. 2).

E3: Transfer Power Source Circuit

The transfer power source circuit E3 applies a transfer bias onto the transfer roller Rt (see FIG. 2).

E4: Fixation Power Source Circuit

The fixation power source circuit E4 supplies heating electric power to the heating roller Fh.

D2: Sheet Transport Drive Circuit

The sheet transport drive circuit D2 drives a sheet transport drive motor M3, thereby driving the pick-up roller Rp and the registration roller Rr by way of clutches CL, CL; and directly driving the paper feed roller Rs, the transport roller Ra, the reverse path transport roller R2, and the like. In addition, the sheet transport drive circuit D2 drives the main body discharge roller R1 by way of a main body forward-rotation clutch CL1 and a main body reverse-rotation clutch CL2. Meanwhile, when the main body forward-rotation clutch CL1 is turned on, and the main body reverse-rotation clutch CL2 is turned off, the main body discharge roller R1 rotates forward (rotation for discharging a sheet onto the tray); and when the main body forward-rotation clutch CL1 is turned off, and the main body reverse-rotation clutch CL2 is turned on, the main body discharge roller R1 rotates in reverse (rotation for transporting a sheet to the sheet reverse path SH1) The discharge roller R1 can be rendered capable of rotating in the forward and reverse directions without using the clutches CL1, CL2, by means of employing a sheet transport drive motor whose rotation direction can be reversed.

D3: Tray-Switching Solenoid Drive Circuit

The tray-switching solenoid drive circuit D3 controls on-off of a solenoid for the tray-switching gate 54, thereby moving the tray-switching gate 54 between the face-down discharge position (the position shown in FIG. 9A) and the face-up discharge position (the position shown in FIG. 9B). Under normal conditions or in a case where the optional face-down tray TRh1 is designated, in the tray-switching solenoid drive circuit D3 of the first embodiment, the solenoid is turned off, whereby the tray-switching gate 54 is retained at the face-down discharge position by means of a spring. When a user designates the optional face-up tray TRh2, the tray-switching solenoid drive circuit D3 turns on the solenoid, whereby the tray-switching gate 54 is caused to move to the face-up discharge position.

D4: Discharge Device Switching Motor Drive Circuit

The discharge device switching motor drive circuit D4 controls a rotation angle of a motor for the discharge device switching gate GT1, thereby causing the discharge device switching gate GT1 to move between the position for discharge onto the main body tray, the position for transport to the reversing device, and the position for discharge to the optional discharge unit.

D5: Optional Discharge Unit Drive Circuit

The optional discharge unit drive circuit D5 drives an optional discharge unit drive motor M4, thereby driving the face-down discharge roller 28 and the common transport path transport rollers 60 by way of an optional forward-rotation clutch CL3 and an optional reverse-rotation clutch CL4, and directly driving the face-up discharge roller 51. Meanwhile, when the optional forward-rotation clutch CL3 is turned on, and the optional reverse-rotation clutch CL4 is turned off, the optional discharge rollers (the face-down discharge roller 28 and the common transport path transport rollers 60) rotate forward; and when the optional forward-rotation clutch CL3 is turned off, and the optional reverse-rotation clutch CL4 is turned on, the optional discharge rollers 28, 60 rotate in reverse. The optional discharge unit drive circuit D5, the optional discharge drive motor M4, the optional clutches CL3, CL4, and the like are incorporated in the optional discharge unit U6. The optional discharge rollers 28, 60 can be rendered capable of rotating in the forward and reverse directions without using the clutches CL3, CL4, by means of employing a sheet transport drive motor whose rotation direction can be reversed.

The controller C has programs for implementing functions for executing processing in accordance with output signals from the respective signal output elements, thereby outputting control signals to the respective control elements. Next, the programs of the controller C for implementing the respective functions will be described below.

C1: Main Motor Rotation Controller

The main motor rotation controller C1 controls the main motor drive circuit D, thereby controlling rotation of the photosensitive member PR, the developing roller Ga of the developing device G, the fuser F, and the like.

C2: Power Source Circuit Controller

The power source circuit controller C2 has the following C2*a* to C2*d*, and controls the power source circuit E, thereby controlling the developing bias, the electrifying bias, the transfer bias, on-off of a heater of the heating roller Fh, and the like.

C2*a*: Developing Bias Controller

The developing bias controller C2*a* controls operations of the developing bias power source circuit E1, thereby controlling the developing bias applied onto the developing roller Ga of the developing device G.

C2*b*: Electrifying Bias Controller

The electrifying bias controller C2*b* controls operations of the electrifying bias power source circuit E2, thereby controlling the electrifying bias applied onto the respective electrifying rollers CR.

C2*c*: Transfer Bias Controller

The transfer bias controller C2*c* controls operations of the transfer bias power source circuit E3, thereby controlling the transfer bias applied onto the transfer roller Rt.

C2*d*: Fixation Power Source Controller

The fixation power source controller C2*d* controls the fixation power source circuit E4, thereby controlling on-off of the heater of the heating roller Fh.

C3: Latent Image Formation Controller

The latent image formation controller C3 controls operations of the laser drive circuit DL, thereby driving respective laser diodes (not shown) of the ROS (the latent image forming device) to thus form latent images on the surface of the image carrier PR.

C4: Optional Discharge Unit Mounting Memory

The optional discharge unit mounting memory C4 memorizes whether or not the optional discharge unit U6 is attached to the image forming apparatus U1. Meanwhile, the first embodiment is configured such that whether or not the optional discharge unit U6 is attached is memorized upon receipt of an input from the user interface UI; however, by means of disposing a sensor, it can be caused to monitor upon automatic detection.

C5: Finisher Transport Device Mounting Memory

The finisher transport device mounting memory C5 memorizes whether or not the finisher transport device U5 is attached on the main body discharge tray TRh. Meanwhile, the first embodiment is configured such that whether or not the finisher transport device U5 is attached is memorized upon receipt of an input from the user interface U1; however, by means of disposing a sensor, it can be caused to monitor upon automatic detection.

C6: Discharge Onto Optional Face-Up Tray Enabled/Disabled Determination Part

The discharge onto optional face-up tray enabled/disabled determination part C6 determines whether or not a sheet can be discharged onto the optional face-up tray TRh2, on the basis of a detection signal output from the tray detection sensor SN1, and stores the result. More specifically, when the tray detection sensor SN1 has failed to detect the optional face-up tray TRh2 (i.e., the sensor is off), the optional discharge tray TRh2 is not attached, or the front end thereof is pivoted upward. Accordingly, discharge onto the optional face-up tray enabled/disabled determination part C6 determines that the sheet cannot be discharged onto the optional discharge tray TRh2, and memorizes prohibition of discharge of a sheet onto the optional face-up tray TRh2. In contrast, when the tray detection sensor SN1 detects the optional face-up tray TRh2, the discharge onto the optional face-up tray enabled/disabled determination part C6 determines that the sheet can be discharged, and memorizes the result.

C7: Double-Sided Printing Designation Memory

The double-sided printing designation memory C7 memorizes whether or not double-sided printing is designated, on the basis of an input by a user by means of the double-sided printing designation key UI5 of the user interface U1.

C8: Discharge Tray Designation Memory

The discharge tray designation memory C8 memorizes which tray is designated among the main body discharge tray TRh, the optional face-down tray TRh1, and the optional face-up tray TRh2, on the basis of an input by a user by means of the discharge tray setting key UI6 of the user interface U1. When the main body discharge tray TRh is designated in a case where the finisher transport device U5 attached, a sheet is transported to the finisher U4.

C9: Postprocessing Designation Memory

The postprocessing designation memory C9 memorizes, in accordance with an input by a user by means of the postprocessing setting key UI7 of the user interface U1, which one is designated among: as-is-discharging onto the top tray U4*a*, an end-binding to bind an end of a bundle of sheets, or a saddle-binding to bind a center of a bundle of sheets.

C10: Sheet Feed Controller

The sheet feed controller C10 has C10A for determining transport of an immediately-preceding sheet transport (hereinafter referred to as "immediately-preceding sheet transport determination part"), C10B for determining transport of a sheet before the immediately preceding sheet (hereinafter referred to as "sheet-before-immediately-preceding-sheet transport determination part C10B"), C10C for determining a position where a sheet can be fed for double-sided printing (hereinafter referred to as "double-sided-print-paper-feedable-position passage determination part"), and CLOD for determining a position where a sheet can be fed between sheets (hereinafter referred to as "inter-sheet-paper-feedable-position passage determination part"). The sheet feed controller C10 controls timing of paper feed performed by the pick-up roller Rp.

C10A: Immediately-Preceding Sheet Transport Determination Part

The immediately-preceding sheet transport determination part C10A determines, at the time of paper feed, whether or not a sheet which has been fed immediately previously (an immediate preceding sheet) is being transported.

C10B: Sheet-Before-Immediately-Preceding-Sheet Transport Determination Part C10B The sheet-before-immediately-preceding-sheet transport determination part C10B determines, at the time of sheet feeding, whether or not a sheet which has been fed previous to the immediately preceding sheet (a sheet before the immediately preceding sheet) is being transported.

C10C: Inter-Sheet-Paper-Feedable-Position Passage Determination Part

The inter-sheet-paper-feedable-position passage determination part C10C determines, at a time of double-sided printing, whether or not a front end of a sheet to be fed has passed through a predetermined position (a position where a sheet can be fed for double-sided printing), which the sheet is to reach later than the rear end of an immediately preceding sheet which is being transported to the sheet-reversing device U3 after being switched-back. The inter-sheet-paper-feedable-position passage determination part C10C of the first embodiment determines the above on the basis of time elapsed since a feed start of the immediately preceding sheet. However, the passage of a sheet can also be determined by means of disposing a sheet sensor at the position where a sheet can be fed for double-sided printing.

C10D: Inter-Sheet-Paper-Feedable-Position Passage Determination Part

The inter-sheet-paper-feedable-position passage determination part C10D determines, at a time of double-sided printing and in a case where a sheet is to be fed between a sheet before the immediately preceding sheet and the immediately preceding sheet, whether or not a front end of the sheet to be fed has passed through a predetermined position (a position where paper can be fed between sheets, and this position will be hereinafter called an "inter-sheet paper feedable position"), which the sheet is to reach later than the rear end of the sheet before the immediately preceding sheet. The inter-sheet-paper-feedable-position passage determination part C10D of the first embodiment determines the above on the basis of time length elapsed since a feed start of the sheet before the immediately preceding sheet. However, the passage of a sheet can also be determined by means of disposing a sheet sensor at the position where a sheet can be fed for double-sided printing.

C11: Tray-Switching Gate Controller

The tray-switching gate controller C11 moves the tray-switching gate 54 to either of the face-down discharge position or the face-up discharge position in accordance with a tray (the optional face-down tray TRh1 or the optional face-up tray TRh2) designated by a user.

C12: Discharge Device Switching Gate Controller

The discharge device switching gate controller C12 has a gate passage determination part C12A and a first side printing completion determination part C12B; and moves the discharge device switching gate GT1 to any one of the position for discharge onto the main body tray, the position for transport to the reversing device, and the position for discharge to the optional discharge unit.

C12A: Gate Passage Determination Part

The gate passage determination part C12A determines whether or not the rear end of the sheet in the transport direction has passed through the discharge device switching gate GT1. The passage determination part for gate passage determination part C12A of the first embodiment determines the above on the basis of time length elapsed since a feed start of the sheet. However, the passage of a sheet can also be determined by means of disposing a sheet sensor.

C12B: First Side Printing Completion Determination Part

The first side printing completion determination part C12B determines whether a sheet to be transported to the discharge device switching gate GT1 next, that is, a sheet which has passed through the fuser F is a sheet whose first side of double-sided printing has been printed or a sheet whose second side has been printed.

C13: optional Discharge Roller Rotation Controller (Optional Discharge Member Rotation Controller)

The optional discharge roller rotation controller C13 controls rotation of the optional discharge unit drive motor M4, thereby controlling driving of the optional discharge rollers (face-down discharge roller 28, the face-up discharge roller 51, and the common-transport-path transport rollers 60).

Descriptions of Flowchart Depicting First Embodiment (Descriptions of Main Flowchart Depicting Sheet Feed Processing)

Figure 15:
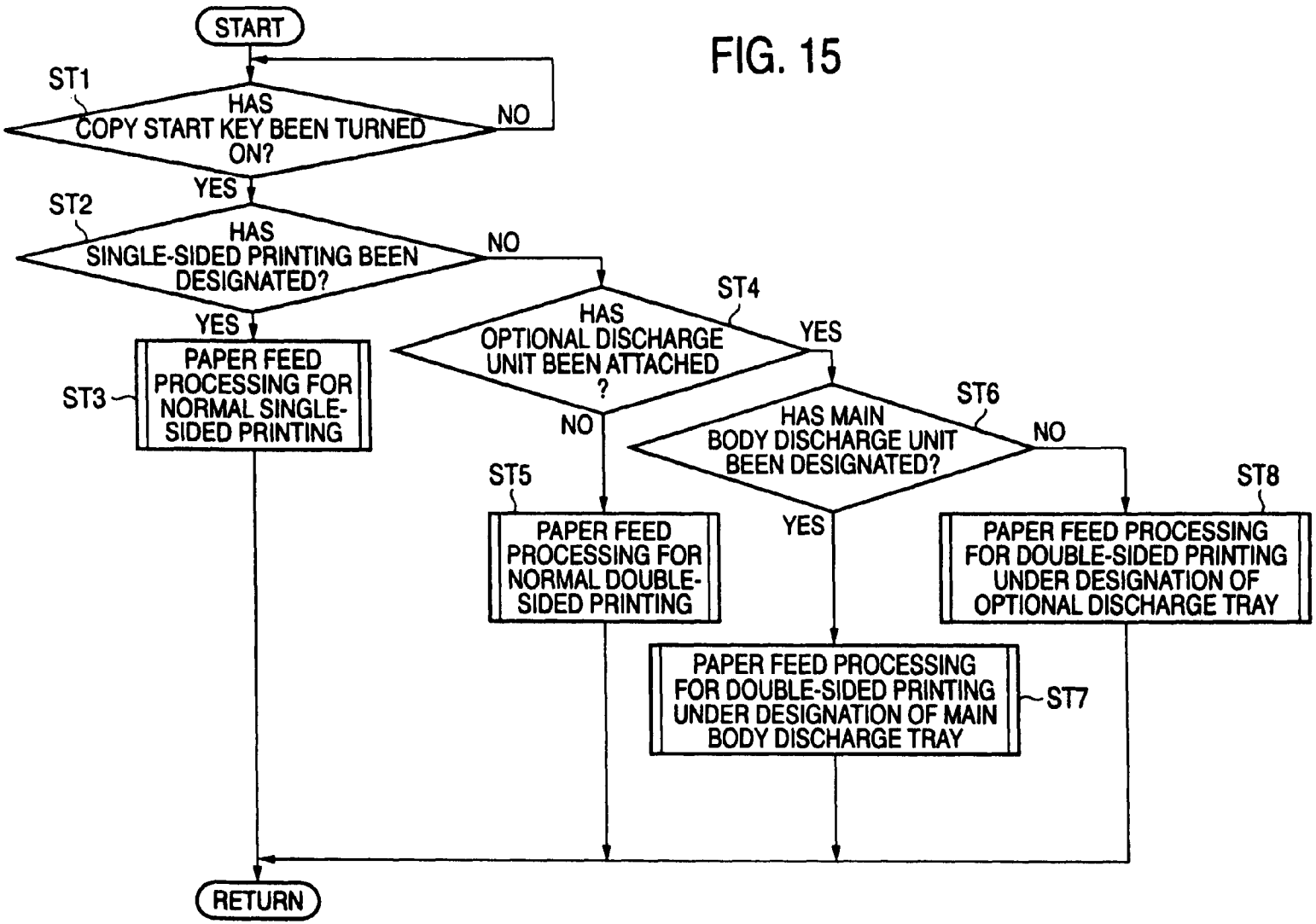
FIG. 15 is a main flowchart depicting sheet feed processing of the image forming apparatus of the first embodiment.

FIG. 15 is a main flowchart depicting sheet feed processing of the image forming apparatus of the first embodiment.

Processing of respective ST (steps) of the flowchart in FIG. 15 is executed in accordance with programs stored in a ROM, a hard disk, or the like of the controller C. In addition, the processing is executed in a form of parallel processing concurrent with other various processing of the image forming apparatus U.

The sheet feed processing shown in FIG. 15 is started by power-on of the image forming apparatus U.

In ST1 in FIG. 15, a determination is made as to whether or not a job has started; that is, whether or not the copy start key UI2 has been turned on. When the result of determination is NO (N), ST1 is repeated; when the result is YES (Y), processing proceeds to ST2.

In ST2, a determination is made as to whether or not single-sided printing has been designated. When the result of determination is YES (Y), processing proceeds to ST3; when the result is NO (N), processing proceeds to ST4.

In ST3, paper feed processing for normal single-sided printing is performed. More specifically, sheets are sequentially supplied for performing single-sided printing. Thereafter, processing returns to ST1.

In ST4, a determination is made as to whether or not the optional discharge unit U6 is attached. When the result of determination is NO (N), processing proceeds to ST5; when the result is YES (Y), processing proceeds to ST6.

In ST5, paper feed processing for normal double-sided printing is performed. More specifically, a new sheet is supplied every time an immediately preceding sheet which has been caused to switch-back by the main body discharge roller R1, thereby being transported to the sheet-reversing device U3 passes through the position where a sheet can be fed for double-sided printing. Thereafter, processing returns to ST1.

In ST6, a determination is made as to whether or not the main body discharge tray TRh has been designated. More specifically, when the finisher U4 and the finisher transport device U5 are attached, a determination is made as to whether or not transport to the finisher U4 has been designated. When the result of determination is YES (Y) (i.e., when the main body discharge tray TRh or the finisher U4 has been designated), processing proceeds to ST7; when the result is NO (N), processing proceeds to ST8.

In ST7, paper feed processing for double-sided printing for a case where the main body discharge tray has been designated is performed. This is sheet feed processing for a case where double-sided printing is performed through use of the optional discharge unit U6, and a sheet is discharged onto the main body discharge tray TRh (in the case of the image forming apparatus U of the first embodiment to which the finisher U4 is attached, to the finisher U4) (see the subroutine shown in FIG. 16, which will be described later). Thereafter, processing returns to ST1.

In ST8, paper feed processing for double-sided printing under designation of the optional discharge tray is performed. This is paper feed processing for performing double-sided printing through use of the optional discharge unit U6 and discharging a sheet onto the optional discharge tray designated by a user (the optional face-down tray TRh1 or the optional face-up tray TRh2). More specifically, a new sheet is supplied every time an immediately preceding sheet which has been switched-back by face-down discharge roller 28 of the optional discharge unit U6, thereby being transported to the sheet-reversing device U3 passes through a predetermined position where a sheet for double-sided printing can be fed. Thereafter, processing returns to ST1.

(Description of Flowchart Depicting Paper Feed Processing for Double-sided Printing Under Designation of Main Body Discharge Tray)

FIG. 16 is a flowchart depicting the paper feed processing for double-sided printing under designation of the main body discharge tray; i.e., a flowchart depicting a subroutine of ST7 shown in FIG. 15.

In ST11 in FIG. 16, a determination is made as to whether or not image data for a first side are present. More specifically, a determination is made as to whether or not a new sheet must be fed. When the result of determination is YES (Y), processing proceeds to ST12; when the result is NO (N), processing proceeds to ST17.

In ST12, a determination is made as to whether or not the immediately preceding sheet is being transported through a sheet path (any one of the sheet transport path SH, the sheet reverse path SH1, the face-down transport path 61, and the common transport path 63). When the result of determination is YES (Y), processing proceeds to ST13; when the result is NO (N), processing proceeds to ST16.

In ST13, a determination is made as to whether or not a sheet preceding the immediately preceding sheet; that is, a sheet before the immediately preceding sheet, is being transported through a sheet path. When the result of determination is YES (Y), processing proceeds to ST14; when the result is NO (N), processing proceeds to ST15.

In ST14, a determination is made as to whether or not the rear end position of the sheet before the immediately preceding sheet in the transport direction has passed through the inter-sheet paper feedable position. When the result of determination is YES (Y), processing proceeds to ST16; when the result is NO (N), processing repeats ST14.

In ST15, a determination is made as to whether or not a rear end position of the immediately preceding sheet in the transport direction has passed through the position where a sheet can be fed for double-sided printing. When the result of determination is YES (Y), processing proceeds to ST16; when the result is NO (N), processing repeats ST15.

In ST16, the pick-up roller Rp is driven, to thus supply a new sheet. Thereafter, processing proceeds to ST17.

In ST17, a determination is made as to whether or not the job has been completed; more specifically, whether or not image data remain. When the result of determination is NO (N), processing proceeds to ST11; when the result is YES (Y), the subroutine shown in FIG. 16 is completed and processing returns to the main routine shown in FIG. 15.

(Description of Main Flowchart Depicting Gate Switching Processing for Switching Discharge Device)

Figure 17:
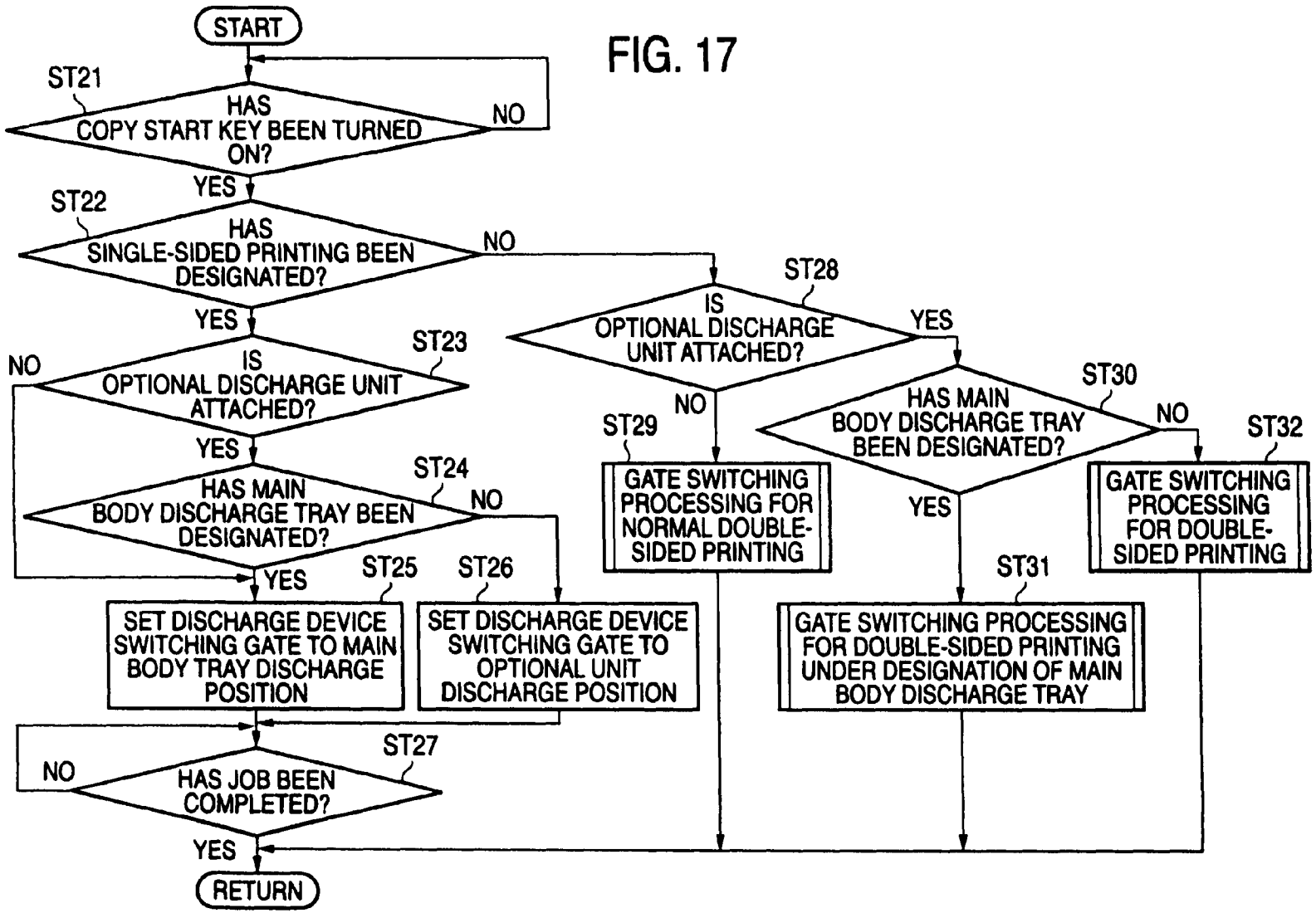
FIG. 17 is a main flowchart depicting a main flowchart of gate switching processing for switching discharge device of the image forming apparatus of the first embodiment.

FIG. 17 is a main flowchart depicting a main flowchart of-gate switching processing for switching a discharge device of the image forming apparatus of the first embodiment.

Processing of respective ST (steps) of the flowchart in FIG. 17 is executed by programs stored in a ROM, a hard disk, or the like of the controller C. In addition, the processing is executed as parallel processing concurrent with various other processing operations executed by the image forming apparatus U.

The sheet feed processing shown in FIG. 17 is started by power-on of the image forming apparatus U.

In ST21 in FIG. 17, a determination is made as to whether or not a job has started; more specifically, whether or not the copy start key UI2 has been turned on. When the result of determination is NO (N), ST21 is repeated; when the result is YES (Y), processing proceeds to ST22.

In ST22, a determination is made as to whether or not single-sided printing has been designated. When the result of determination is YES (Y), processing proceeds to ST23; when the result is NO (N), processing proceeds to ST28.

In ST23, a determination is made as to whether or not the optional discharge unit U6 has been attached. When the result of determination is YES (Y), processing proceeds to ST24; when the result is NO (N), processing proceeds to ST25.

In ST24, a determination is made as to whether or not the main discharge tray TRh has been designated as a tray onto which a sheet is to be discharged (in the case of the image forming apparatus U in the first embodiment, whether or not the postprocessing by the finisher U4 has been designated). When the result of determination is YES (Y), processing proceeds to ST25; when the result is NO (N), processing proceeds to ST26.

In ST25, the discharge device switching gate GT1 is set to the main body tray discharge position; that is, a position from which the sheet is discharged onto the main body discharge tray TRh. Thereafter, processing proceeds to ST27.

In ST26, the discharge device switching gate GT1 is set to the optional tray discharge position that is a position from which the sheet is discharged onto the optional discharge tray (the optional face-down tray TRh1 or the optional face-up tray TRh2). Thereafter, processing proceeds to ST27.

In ST27, a determination is made as to whether or not the job has been completed. When the result of determination is NO (N), ST27 is repeated; when the result is YES (Y), processing returns to ST21.

In ST28, a determination is made as to whether or not the optional discharge unit U6 has been attached. When the result of determination is NO (N), processing proceeds to ST29; when the result is YES (Y), processing proceeds to ST30.

In ST29, gate switching processing for normal double-sided printing is performed. More specifically, when a sheet on which an image has been recorded is to be guided toward the main body discharge tray TRh for double-sided printing, the discharge device switching gate GT1 is set to the main body tray discharge position. When a sheet is to be guided away from the main body discharge tray TRh and toward the sheet-reversing device U3, the discharge device switching gate GT1 is set to the reversing device transport position. Thereafter, processing proceeds to ST21.

In ST30, a determination is made as to whether or not the main body discharge tray TRh has been designated as a tray onto which the sheet is to be discharged. When the result of determination is YES (Y), processing proceeds to ST31; when the result is NO (N), processing proceeds to ST32.

In ST31, there is performed gate switching processing for double-sided printing under designation of the main body discharge tray. This is switching processing of the discharge device switching gate GT1 for a case where double-sided printing is to be performed through use of the optional discharge unit U6, and a sheet is to be discharged onto the main body discharge tray TRh (or the finisher U4) (see the subroutine shown in FIG. 18, which will be described later). Thereafter, processing returns to ST21.

In ST32, there is performed gate switching processing for double-sided printing under designation of the optional discharge tray. This is switching processing of the discharge device switching gate GT1 for a case where a sheet which has been subjected to double-sided printing is to be discharged onto the optional discharge tray designated by a user (the optional face-down tray TRh1 or the optional face-up tray TRh2) (see the subroutine shown in FIG. 19, which will be described later). Thereafter, processing returns to ST21.

(Description of Gate Switching Processing for Double-sided Printing Under Designation of Main Body Discharge Tray)

Figure 18:
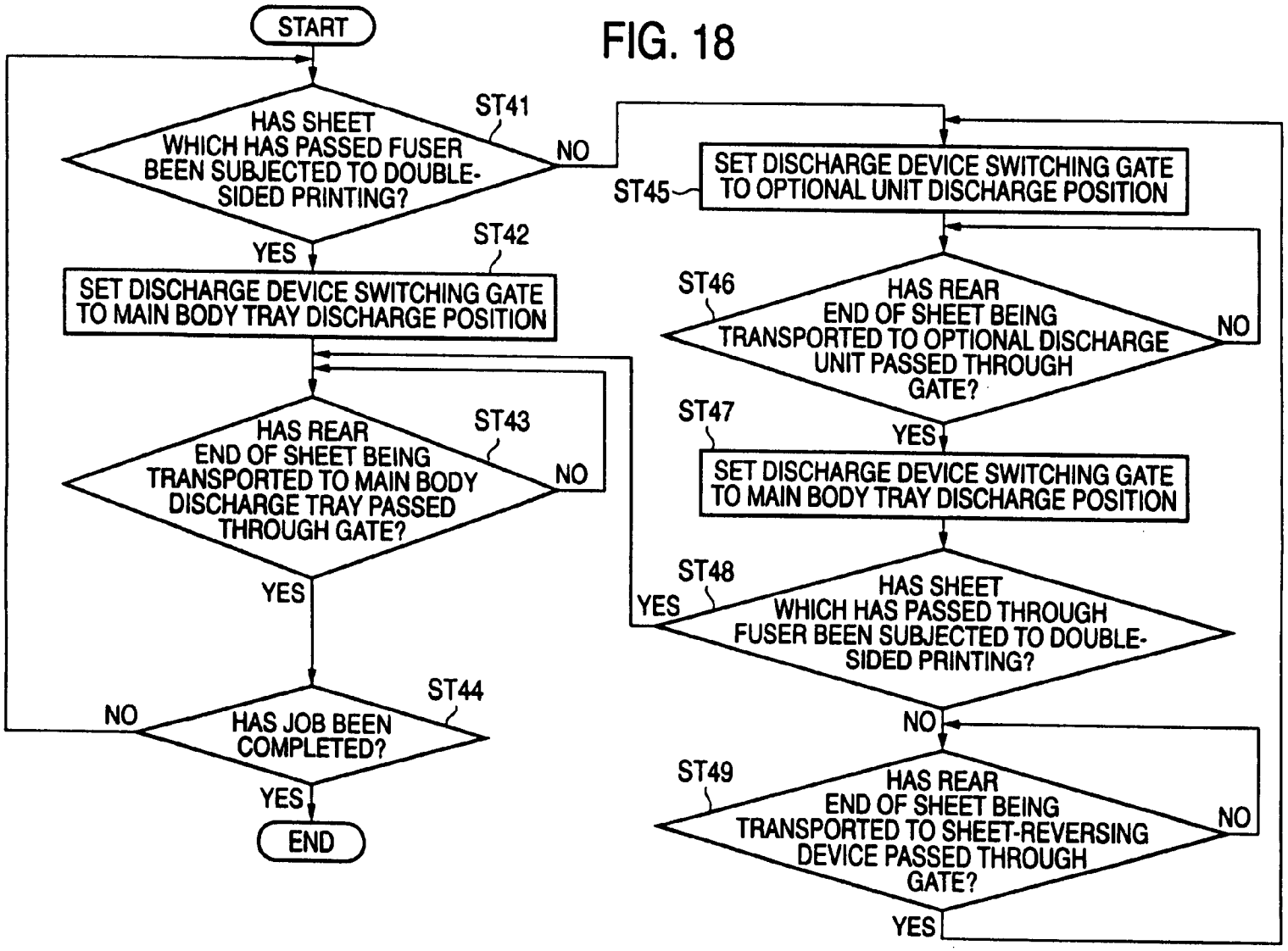
FIG. 18 is a flowchart depicting the gate switching processing for double-sided printing under designation of the main body discharge tray, and is a flowchart depicting a subroutine of ST31 shown in FIG. 17.

FIG. 18 is a flowchart depicting the gate switching processing for double-sided printing under designation of the main body discharge tray, and is a flowchart depicting a subroutine of ST31 shown in FIG. 17.

In ST 41 in FIG. 18, a determination is made as to whether or not a sheet which has passed through the fuser F has been subjected to double-sided printing. When the result of determination is YES (Y), processing proceeds to ST42; when the result is NO (N), processing proceeds to ST45.

In ST42, the discharge device switching gate GT1 is set to the main body tray discharge position. Thereafter, processing proceeds to ST43.

In ST43, a determination is made as to whether or not the rear end of the sheet to be discharged onto the main body discharge tray in the transport direction has passed through the position of the discharge device switching gate GT1. When the result of determination is NO (N), ST43 is repeated; when the result is YES (Y), processing proceeds to ST44.

In ST44, a determination is made as to whether or not the job has been completed. When the result of determination is NO (N), processing returns to ST41; when the result is YES (Y), the gate switching processing for double-sided printing under designation of the main body discharge tray in FIG. 18 is completed, and processing returns to the gate switching processing for switching the discharge device shown in FIG. 17.

In ST45, the discharge device switching gate GT1 is set to the optional unit discharge position. Thereafter, processing proceeds to ST46.

In ST46, a determination is made as to whether or not the rear end in the transport direction of the sheet in the course of transport to the optional discharge unit U6 has passed through the position of the discharge device switching gate GT1. When the result of determination is NO (N), ST46 is repeated; when the result is YES (Y), processing proceeds to ST47.

In ST47, the discharge device switching gate GT1 is set to the main body tray discharge position. Thereafter, processing proceeds to ST48.

In ST 48, a determination is made as to whether or not a sheet which has passed through the fuser F has been subjected to double-sided printing. When the result of determination is YES (Y), processing proceeds to ST43; when the result is NO (N), processing proceeds to ST49.

In ST49, a determination is made as to whether or not the rear end in the transport direction of the sheet in the course of transport to the sheet-reversing device U3 has passed through the position of the discharge device switching gate GT1. When the result of determination is NO (N), ST49 is repeated; when the result is YES (Y), processing proceeds to ST45.

(Description of Gate Switching Processing for Double-sided Printing Under Designation of Optional Discharge Tray)

Figure 19:
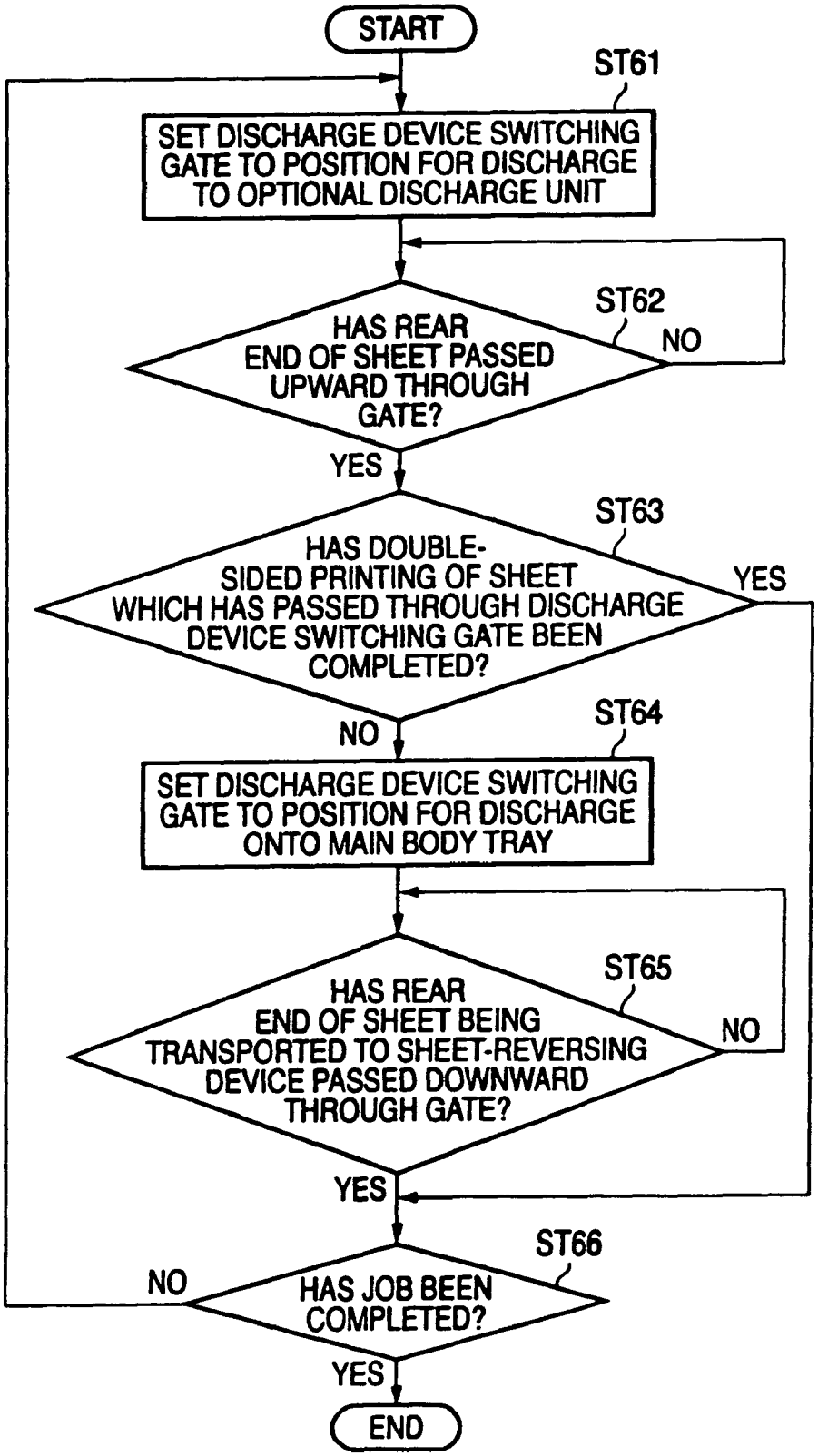
FIG. 19 is a flowchart depicting the gate switching processing for double-sided printing under designation of the optional discharge tray, and is a flowchart depicting a subroutine of ST32 shown in FIG. 17.

FIG. 19 is a flowchart depicting the gate switching processing for double-sided printing under designation of the optional discharge tray, and is a flowchart depicting a subroutine of ST32 shown in FIG. 17.

In ST61 in FIG. 19, the discharge device switching gate GT1 is set to the optional tray discharge position. Thereafter, processing proceeds to ST62.

In ST62, a determination is made as to whether or not the rear end in the transport direction of the sheet on which an image has been recorded has passed through the position of the discharge device switching gate GT1, from below the same to above the same. When the result of determination is NO (N), ST62 is repeated; when the result is YES (Y), processing proceeds to ST63.

In ST 63, a determination is made as to whether or not a sheet which has passed the discharge device switching gate GT1 has been subjected to double-sided printing. When the result of determination is NO (N), processing proceeds to ST64; when the result is YES (Y), processing proceeds to ST66.

In ST64, the discharge device switching gate GT1 is set to the position for discharge onto the main body discharge tray. Thereafter, processing proceeds to ST65.

In ST65, a determination is made as to whether or not the rear end in the transport direction of the sheet being transported to the sheet-reversing device U3 has passed through the position of the discharge device switching gate GT1 from above the same (towards the optional discharge unit U6) to below the same (towards the sheet-reversing device U3). When the result of determination is NO (N), ST65 is repeated; when the result is YES (Y), processing proceeds to ST66.

In ST66, a determination is made as to whether or not the job has been completed. When the result of determination is NO (N), processing returns to ST61; when the result is YES (Y), the gate switching processing for double-sided printing under designation of the optional discharge tray in FIG. 19 is completed, and processing returns to the gate switching processing for switching discharge device shown in FIG. 17.

Effects of First Embodiment

In the image forming apparatus U of the first embodiment which has been configured as described above, a toner image formed on the surface of the photosensitive member PR is transferred to a sheet by means of the transfer roller Rt, and fixed by the fuser F. Thereafter, the sheet on which the toner image has been fixed is, in a case where none of the finisher U4, the finisher transport device U5, and the optional discharge unit U6 is attached (i.e., cases shown in FIG. 1 or 2), discharged onto the main body discharge tray TRh. When the finisher U4, the finisher transport device U5, or the optional discharge unit U6 is attached (i.e., a case shown in FIG. 4), the sheet is discharged to a discharge tray designated by a user (the optional face-down tray TRh1, the optional face-up tray TRh2, the top tray U4*a*, a stack tray of the end-binding device U4*b*, or a discharge tray of the saddle-binding device U4*c*).

Figure 20B:
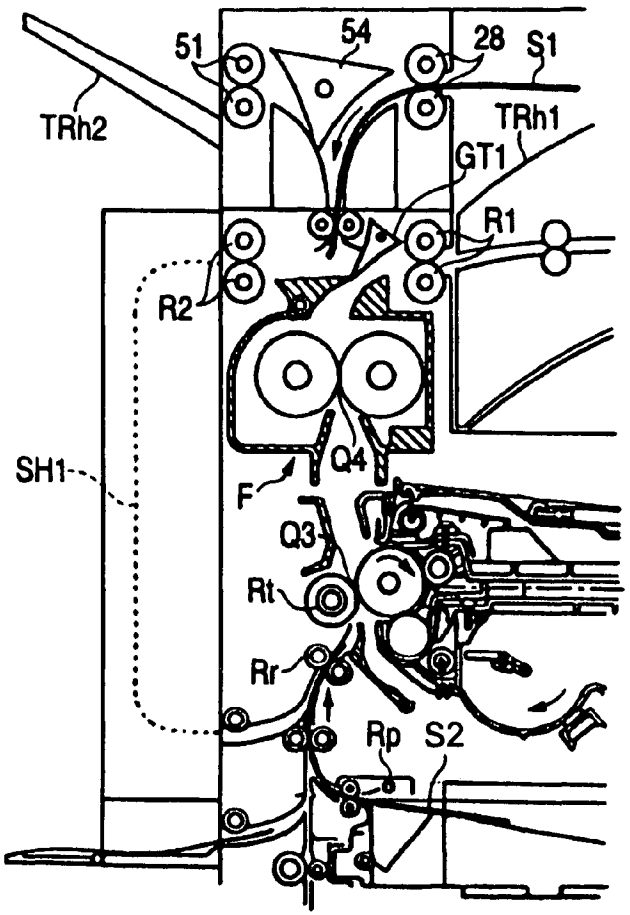
Figure 20A:
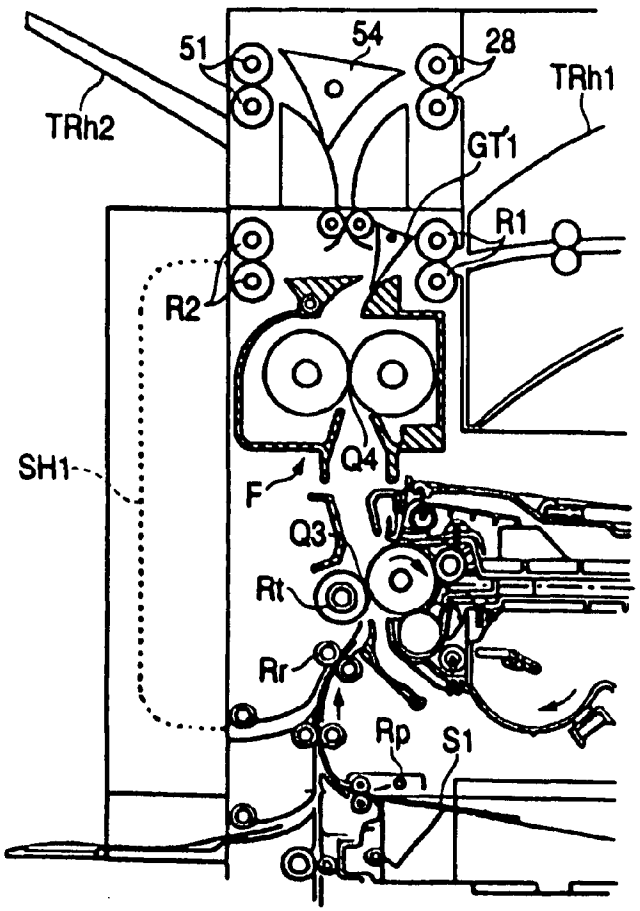

FIGS. 20A and 20B are explanatory views of a sheet transported through the sheet path at the time of double-sided printing of the first embodiment. FIG. 20A is a view showing a state immediately after supply of a first sheet. FIG. 20B is a view showing a state immediately after supply of a second sheet.

Figure 21B:
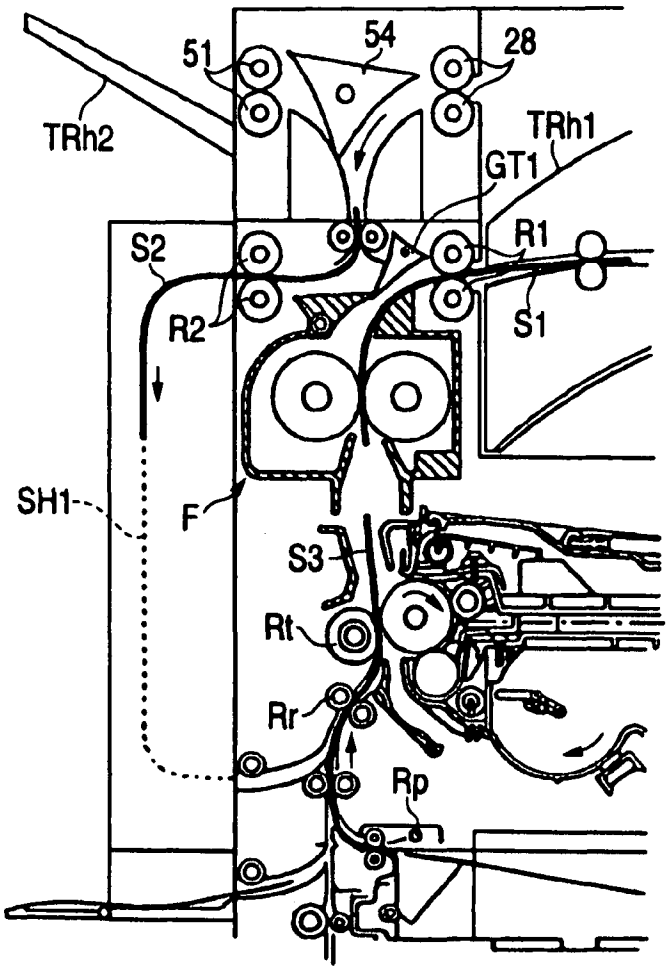
Figure 21A:
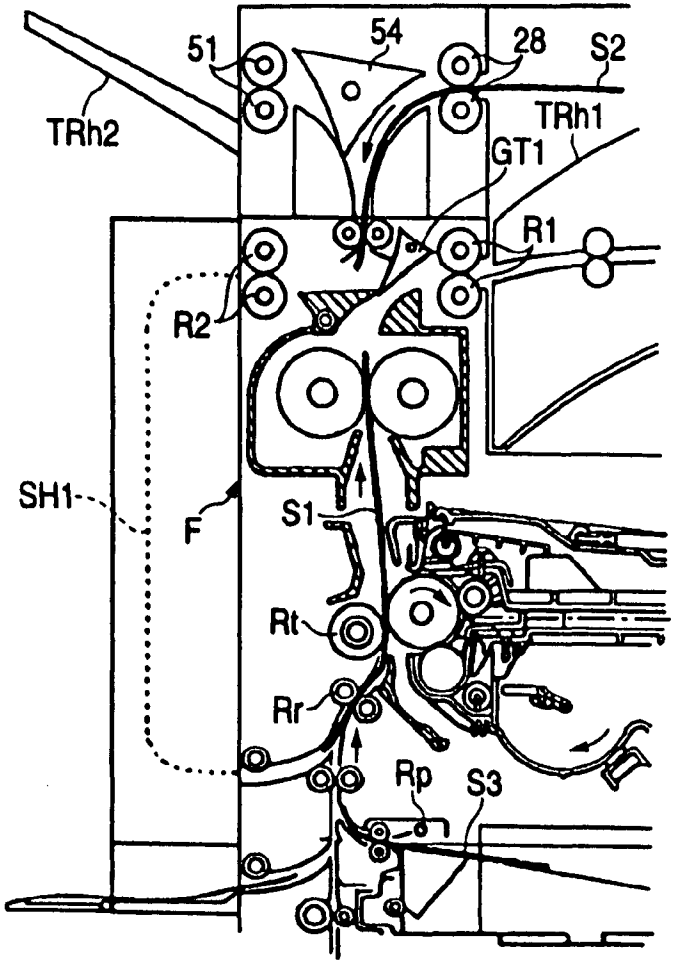

FIGS. 21A and 21B are explanatory views of a sheet transported through the sheet path at the time of double-sided printing of the first embodiment. FIG. 21A is a view showing a state immediately after supply of a third sheet. FIG. 21B is a view showing a state where the first sheet passes through below the discharge device switching gate and the second sheet passes through above the same.

Figure 22:
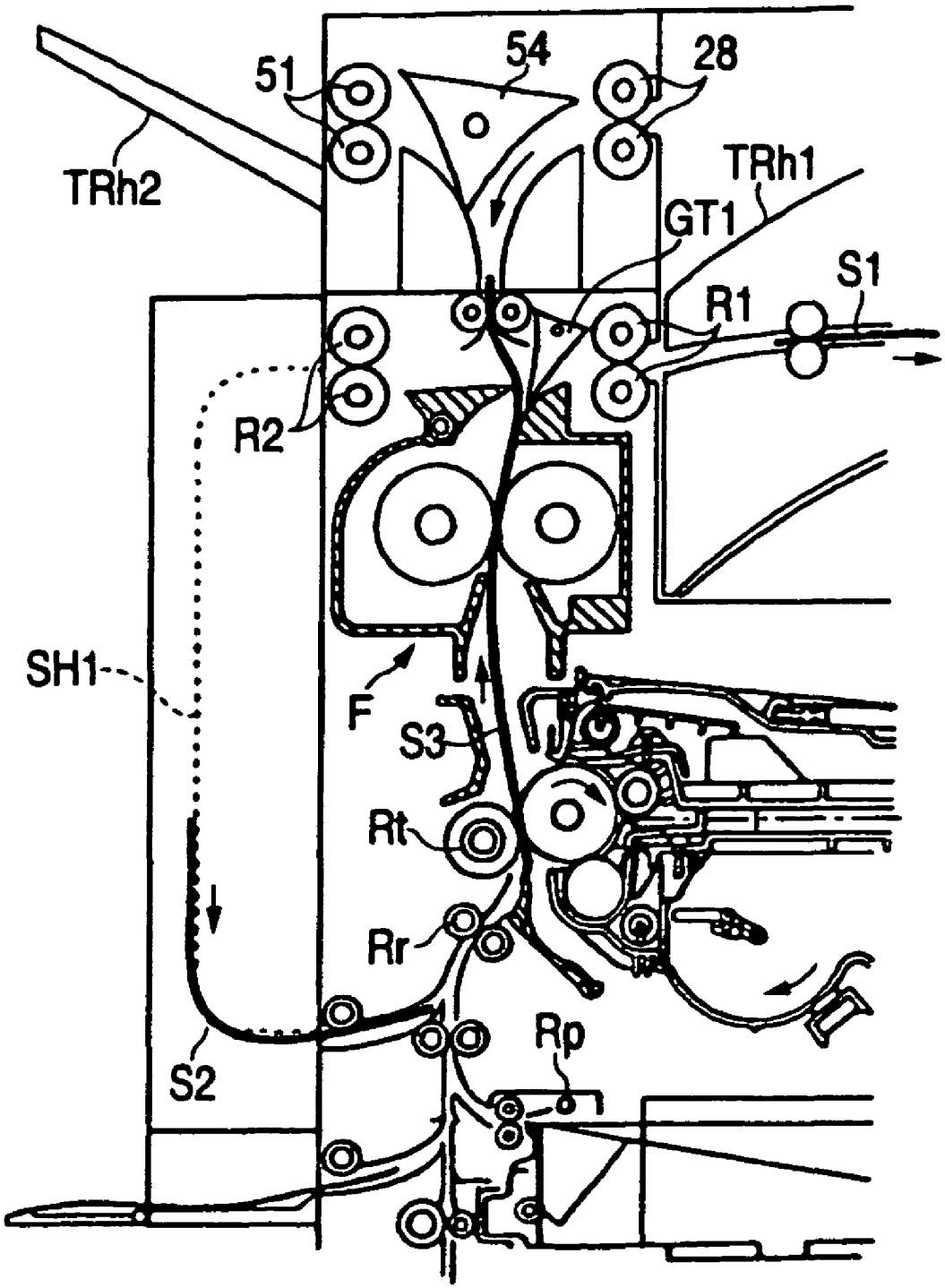
FIG. 22 is an explanatory view of a sheet transported through the sheet path at the time of double-sided printing of the first embodiment, and is a view showing a state where the third sheet is transported to the optional discharge unit.

FIG. 22 is an explanatory view of a sheet being transported through the sheet path at the time of double-sided printing of the first embodiment, and is a view showing a state where the third sheet is transported to the optional discharge unit.

As shown in FIGS. 20A to 22, in the image forming apparatus U of the first embodiment, in a case where double-sided printing has been designated and postprocessing with use of the finisher U4 has been designated with the optional discharge unit U6 attached, the double-sided printing is performed with use of the optional discharge unit U6 (see FIGS. 16 and 18).

As shown in FIG. 20A, immediately after start of the job, the immediately preceding sheet is not transported. Accordingly, a first sheet S1 is fed as a result of processing in ST11, ST12, and ST 16 in FIG. 16. When printing is effected on a first side of the first sheet S1, the discharge device switching gate GT1 moves to the optional unit discharge position (the position shown in FIG. 20A) as a result of processing in ST41 and ST45 in FIG. 18, whereby the sheet S1 is transported to the optional discharge unit U6 (see FIG. 20B).

When the rear end in the transport direction of the first sheet S1 passes through the discharge device switching gate GT1, the discharge device switching gate GT1 moves to the main body tray discharge position (the position shown in FIG. 20B) as a result of processing in ST46 and ST47 in FIG. 18. When, in FIG. 20B, the first sheet S1 is transported to the predetermined position, the face-down discharge roller 28 rotates in reverse, to thus cause switch-back of the first sheet S1. Hence, the first sheet S1 caused to switch-back in the optional discharge unit U6 is guided to the sheet reverse path SH1.

At this time, when the rear end in the sheet transport direction of the first sheet S1 passes through the position where a sheet can be fed for double-sided printing, a second sheet S2 is fed as a result of processing in ST11 to ST13, ST15, and ST16 in FIG. 16. Meanwhile, the position where a sheet can be fed for double-sided printing differs depending on a size of the supplied sheet (A4 size, B5 size, or the like).

When the first sheet S1 is transported to the sheet reverse path SH1, and the rear end of the first sheet S1 passes through the discharge device switching gate GT1 from above the same (away from the optional discharge unit U6) to the left thereof (toward the sheet reverse path SH1), the discharge device switching gate GT1 moves to the optional unit discharge position (the position shown in FIG. 20A) as a result of processing in ST48, ST49, and ST45 in FIG. 18. Accordingly, the second sheet S2 which has passed through the fuser F is guided to the optional discharge unit U6. At this time, since an interval between the first sheet S1 and the second sheet S2 is set to that used during double-sided-printing paper feed, the second sheet S2 is transported to the discharge device switching gate GT1 after passage of the rear end of the first sheet S1 therethrough.

As shown in FIG. 21A, when the rear end of the second sheet S2 passes through the discharge device switching gate GT1, the discharge device switching gate GT1 moves to the main body tray discharge position (the position shown in FIG. 21A) as a result of processing in ST46 and ST47 in FIG. 18.

As shown in FIG. 21A, when the rear end in the sheet transport direction of the first sheet S1 which has been resent to the transfer region Q3 by way of the sheet reverse path SH1 passes through the inter-sheet paper feedable position, a third sheet S3 is supplied as a result of processing in ST11 to ST14, and ST16 in FIG. 16. Meanwhile, the inter-sheet paper feedable position differs among TR1 to TR4 to which paper is fed. However, the inter-sheet paper feedable position can be set to such a position as that from which the third sheet can be transported in succession so as to have a predetermined interval (an interval corresponding to a margin) between the rear end of the sheet before the immediately preceding sheet and the thus-fed sheet (in this case, the first sheet S1).

In FIG. 21B, the first sheet S1 which has passed through the fuser F has finished being subjected to printing of the second side (i.e., double-sided printing has been completed). Therefore, the first sheet S1 is guided on the lower right face of the discharge device switching gate GT1 which has moved to the main body tray discharge position, and transported to the finisher transport path SH2 as a result of processing in ST48 and ST43 in FIG. 18. At this time, the second sheet S2 which has been switched-back in the face-down discharge roller 28 is guided on the upper left surface of the discharge device switching gate GT1, to thus be transported to the sheet reverse path SH1. More specifically, the second sheet S2 passes through the discharge device switching gate GT1 from above the same to the left thereof in conjunction with the first sheet S1 passing through the same from below the same (away from the fuser F) to the right thereof (toward the main body discharge tray TRh).

As shown in FIG. 22, when the rear end of the first sheet S1 passes through the discharge device switching gate GT1, the discharge device switching gate GT1 moves to the optional unit discharge position (the position shown in FIG. 22) as a result of processing in ST43, ST41, and ST45 in FIG. 18. Accordingly, the third sheet S3 is guided by the discharge device switching gate GT1, thereby being transported to the optional discharge unit U6. When image data for a fourth sheet and thereafter remain, the processing shown in FIGS. 21A to 22 is repeated until completion of the job.

Hence, in the conventional technique wherein a sheet has not been reversed by means of the optional discharge unit U6 switch-back is effected with use of the main body discharge roller R1. Therefore, a sheet is not allowed to enter the discharge device switching gate GT1 until the rear end of the immediately preceding sheet passes through the same. However, in the image forming apparatus U of the first embodiment, a sheet is switched-back by means of the optional discharge unit U6. Accordingly, as shown in FIG. 21B, the first sheet which has been subjected to double-sided printing can enter the discharge device switching gate GT1 during the course of switch-back of the second sheet S2, to thus be discharged.

As a result, the image forming apparatus U of the first embodiment enables shortening of intervals between sheets in the course of double-sided printing and intervals between supplied sheets as compared with those of the conventional technique in which paper has been fed only after passage of the immediately preceding sheet. Consequently, speed of image forming (productivity) can be enhanced. In addition, in the image forming apparatus U of the first embodiment, the single discharge device switching gate GT1 performs transport from the optional discharge unit U6 to the sheet reverse path SH1 and transport from the fuser F to the main body discharge tray TRh side. As a result, the number of component parts can be reduced and costs can be reduced.

Furthermore, in the image forming apparatus of the first embodiment, a face-up tray is not attached to the image forming apparatus main body U1; instead, a face-up tray (the optional face-up tray TRh2) is attached to the optional discharge unit U6. Accordingly, the overall image forming apparatus U can be miniaturized in width (the length in the Y-axis direction) as compared with that of the conventional technique wherein a face-up tray is disposed on the sheet-reversing apparatus U3 of the image forming apparatus U1. Furthermore, the optional face-up tray TRh2 is detachable and pivotable by means of the tray support axes 47, 48. Therefore, when not in use, the optional face-up tray TRh2 can be removed or pivoted upward, whereby the image forming apparatus U can be made more compact in terms of width. As a result, the image forming apparatus U can be miniaturized.

In addition, in the optional discharge unit U6 of the first embodiment, the face-up tray TRh2 is attached to the optional discharge unit U6. Accordingly, the face-up tray TRh2 can be added to an image forming apparatus in which a face-up tray is not provided as required by a user. As a result, replacement of the image forming apparatus main body U1 required for attachment of a face-up tray to an image forming apparatus in which a face-up tray is not provided can be obviated; and operations of replacement of components of the sheet-reversing device U3 or the like can also be obviated. Hence, the image forming apparatus can have a simple structure, and its manufacturing cost can be reduced. Furthermore, in the optional discharge unit U6 of the first embodiment, the optional face-up tray TRh2 is detachably attached. Therefore, addition of the face-up tray can also be facilitated.

In the optional discharge unit U6 of the first embodiment, the tray detection sensor SN1 automatically determines whether or not a sheet can be discharged onto the face-up tray TRh2. Therefore, erroneous discharge of a sheet onto the face-up tray TRh2 can be prevented in a case where a sheet cannot be discharged onto the face-up tray TRh2.

Furthermore, in the optional discharge unit U6 of the first embodiment, the receiving-face-angle-retaining link mechanism L retains the sheet-receiving face 71*a* at a predetermined angle upwardly inclined from the horizontal even when the face-up-side case 2 is opened in relation to the face-down-side case 1. Therefore, sheets can be prevented from falling out of the optional face-up tray TRh2 even when the face-up-side case 2 is opened with sheets stacked on the sheet-receiving face 71*a*. As a result, in a case where a jam (paper jam) occurs in the face-down transport path 61, the face-up transport path 62, or the common transport path 63, the jammed sheet can be removed without removing sheets stacked on the optional face-up tray TRh2, thereby facilitating the operation.

Furthermore, in a state where the face-up-side case 2 is opened in relation to the face-down-side case 1, the engaged-when-open section 54*c* fits in the gate-position-retaining engagement section 48*b* of the tray-angle retaining plate 48, whereby the tray-switching gate 54 is retained at the face-up discharge position (the position shown in FIG. 9B). Therefore, since the face-up transport path 62 is open with the face-up-side case 2 open, a jammed sheet can be easily removed when a paper jam (jam) occurs in the face-up transport path 62. Meanwhile, when a jam (paper jam) occurs in the face-down transport path 61 or the common transport path 63, a jammed sheet can be easily removed by merely opening the face-up-side case 2.

Furthermore, the optional discharge unit U6 of the first embodiment is attached laterally (from the left) in relation to the image forming apparatus main body U1, and positioning, locking, and electric connection are effected at the time of attachment. Therefore, even with a copier provided with an IIT (the image forming apparatus U), the optional discharge unit U6 can be easily attached without removing the IIT.

The optional discharge unit U6 of the first embodiment has an offset discharge function, and is capable of discharging a sheet onto the optional face-down tray TRh1 while offsetting the sheet. Accordingly, in a case where the main body discharge roller R1 of the image forming apparatus main body U1 is not provided with an offset discharge function, an offset discharge function can be added thereto by means of mounting the optional discharge unit U6 as required by a user.

Furthermore, in the image forming apparatus U of the first embodiment, when the finisher U4 (postprocessing device) is attached thereto, the finisher U4 can be used by means of attaching the finisher transport device U5, without changing the sheet transport path inside the image forming apparatus main body U1 or without disposing a sheet transport path for the finisher in advance. In the first embodiment, solely the finisher transport path SH2 is formed inside the finisher transport device U5, and there is not provided a gate or a transport member for transporting a sheet onto the optional face-down tray TRh1 on the upper surface. Accordingly, the optional discharge tray TRh1 and the finisher transport path SH2 can be added with a simple structure and low cost; and the lack of necessity to provide a gate or the like prevents the optional discharge tray TRh2 from being reduced in length in the sheet transport direction. In addition, since the simple structure enables narrowing of the gap between the finisher transport path SH2 and the optional face-down tray TRh1, the gap between the optional face-down tray TRh1 and the lower surface of the IIT can be widened. Therefore, the number of sheets that can be stacked on the optional face-down tray TRh1 can be increased; and a take-out opening of sheets becomes wide, whereby a user can easily take out sheets stacked on the optional face-down tray TRh1.

Second Embodiment

Figure 23A:
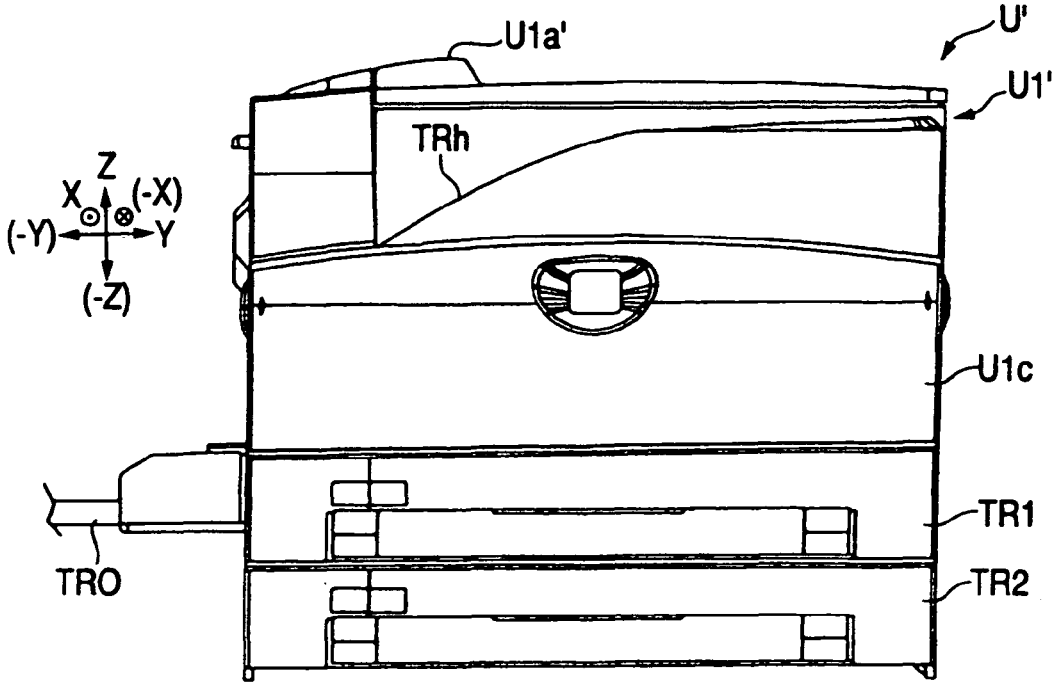
Figure 23B:
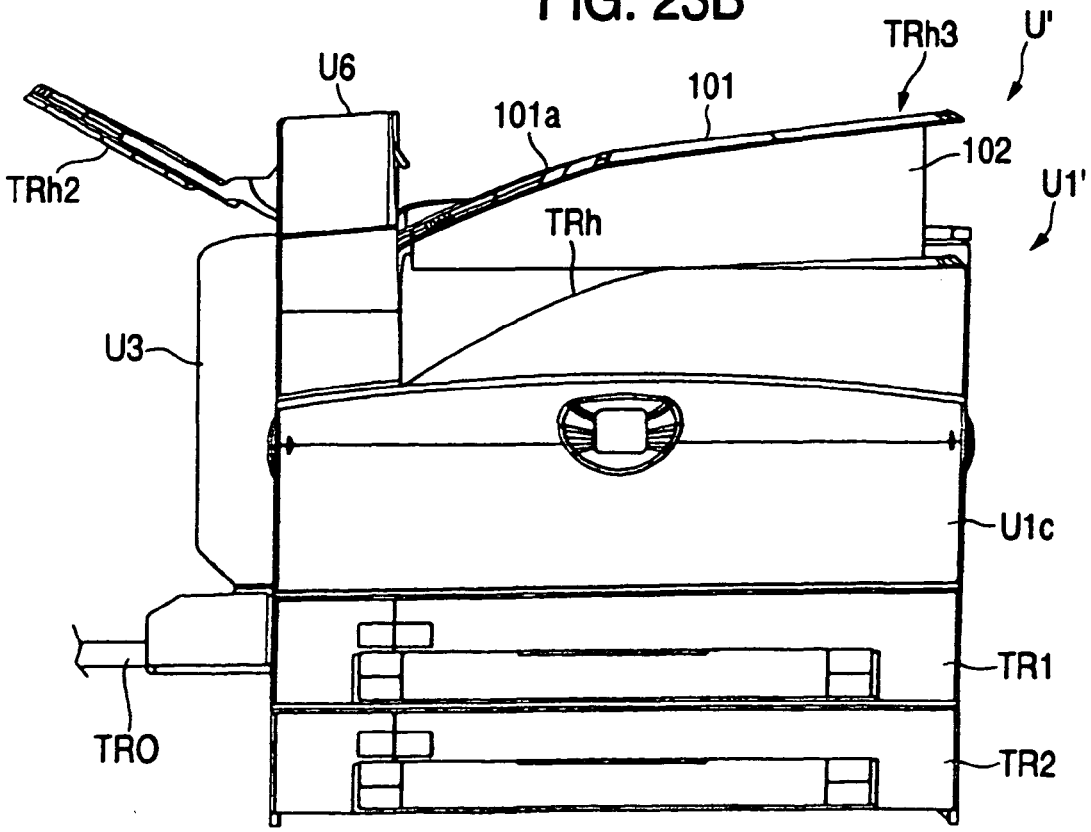

FIGS. 23A and 23B are front views of an image forming apparatus of a second embodiment. FIG. 23A is a front view of a state where the optional discharge unit is not attached. FIG. 23B is a view where a single optional discharge unit is attached.

In the description of the second embodiment, structural elements corresponding to those of the first embodiment are denoted by the same reference numerals, and detailed description thereof is omitted.

The second embodiment differs from the first embodiment in the following respects, but, in other respects, is configured in the same manner as is the first embodiment.

As shown in FIGS. 23A and 23B, a printer U'; that is, an image forming apparatus of the second embodiment, differs from the copier U of the first embodiment in that the IIT and the automatic document transport device U2 are omitted. Therefore, image forming (printing) is performed on the basis of image data transmitted from an information processing device such as a personal computer, or designated data on a discharge tray. On the upper end surface of a printer main body U1' of the printer U' in the second embodiment, there is attached a top cover U1*a*' for protecting a main-body-connector (not shown) configured in the same manner as is the main-body-side connector U11 of the first embodiment.

As shown in FIG. 23B, the same optional discharge unit U6 as that of the first embodiment is attached to the printer U' of the second embodiment. The optional discharge unit U6 is laterally attached and electrically connected to the main-body-side connector.

An optional face-down tray TRh3 is fixedly supported on the image forming apparatus main body U1'. The optional face-down tray TRh3 of the second embodiment has a tray main body 101 including a face-down sheet-placement surface 101*a* on the upper surface thereof, and a main body mounting section 102 which is supported on the rear end (−X end) of the image forming apparatus main body U1'.

Meanwhile, in contrast to the copier U of the first embodiment, the printer U' of the second embodiment does not have a vertically extending frame for supporting the IIT. Therefore, the optional discharge unit U6 is attached to the printer main body U1' without removing the front cover 3 and the rear cover 4.

Effects of Second Embodiment

The image forming apparatus (printer) U' of the second embodiment configured as above can discharge a sheet, in accordance with designation by a user, to any one of the main body discharge tray TRh, the optional face-down tray TRh3, and the optional face-up tray TRh2. In addition, the optional discharge unit U6 of the second embodiment is identical with the copier U of the first embodiment. Therefore, the copier U and the printer U' can use the optional discharge unit U6 in common. In addition, the image forming apparatus (printer) U' of the second embodiment exerts the same effects as those of the image forming apparatus (copier) U of the first embodiment.

Third Embodiment

Figure 24:
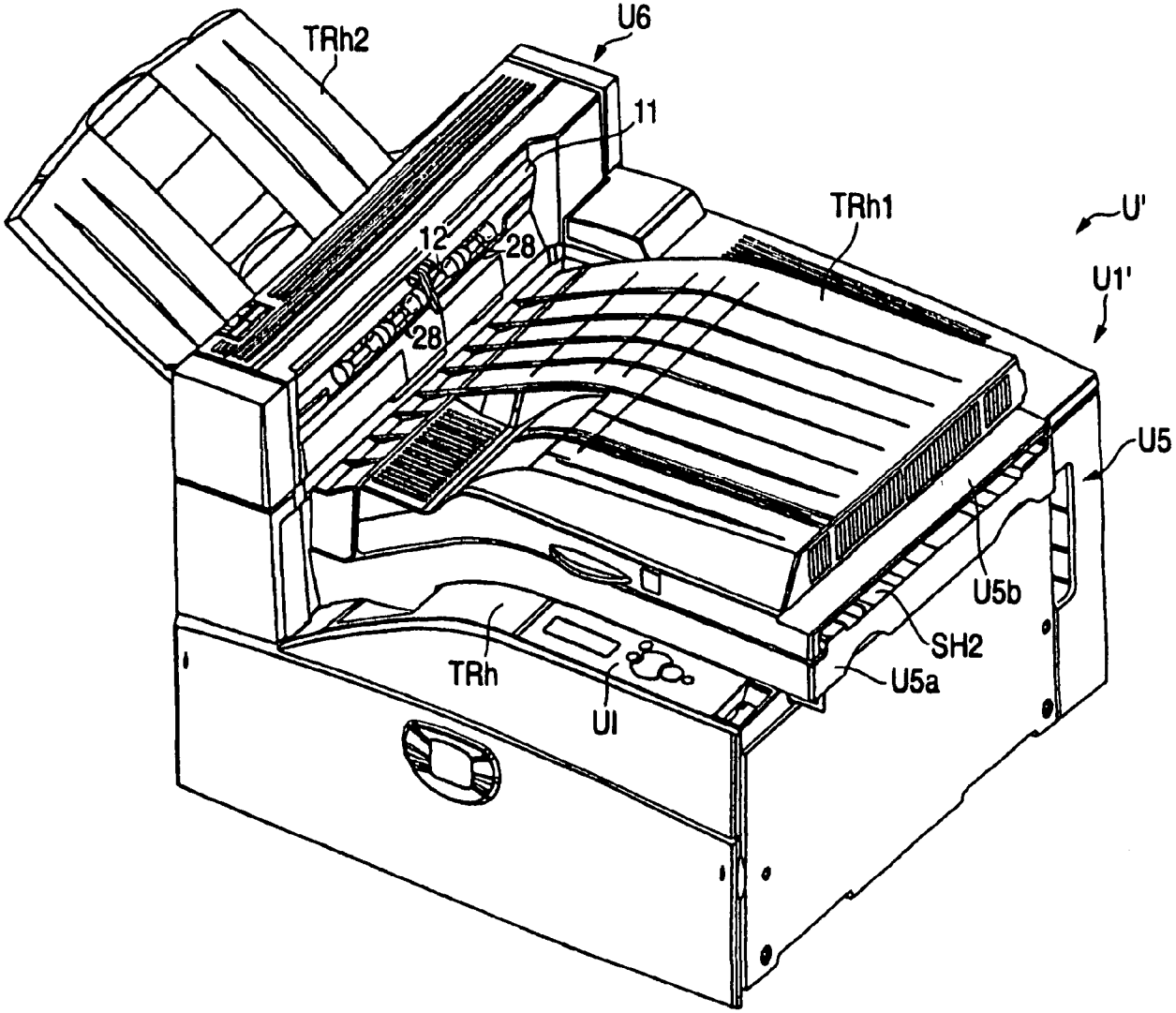
FIG. 24 is a perspective explanatory view of an image forming apparatus of a third embodiment.

FIG. 24 is a perspective explanatory view of an image forming apparatus of a third embodiment.

In the descriptions of the third embodiment, structural elements corresponding to those of the first embodiment are denoted by the same reference numerals, and detailed description thereof is omitted.

The third embodiment differs from the first embodiment in the following respects, but in other respects is configured in the same manner as is the first embodiment.

As shown in FIG. 24, the printer main body U1' of the printer U'; that is, an image forming apparatus of the third embodiment, is configured in the same manner as is the printer main body U1' of the printer U' of the second embodiment. A finisher transport device U5 which is identical with that of the first embodiment is attached onto the main body discharge tray TRh.

Effects of Third Embodiment

The same finisher transport device U5 as attached to the copier U of the first embodiment can be attached to the printer U1 of the third embodiment which is configured as above. Therefore, the finisher transport device U5 and the unillustrated finisher (postprocessing device) can be used in common. In addition, the printer U1 of the third embodiment exerts the same effects as those of the image forming apparatus U, U1 of the first and second embodiments.

Fourth Embodiment

Figure 25:
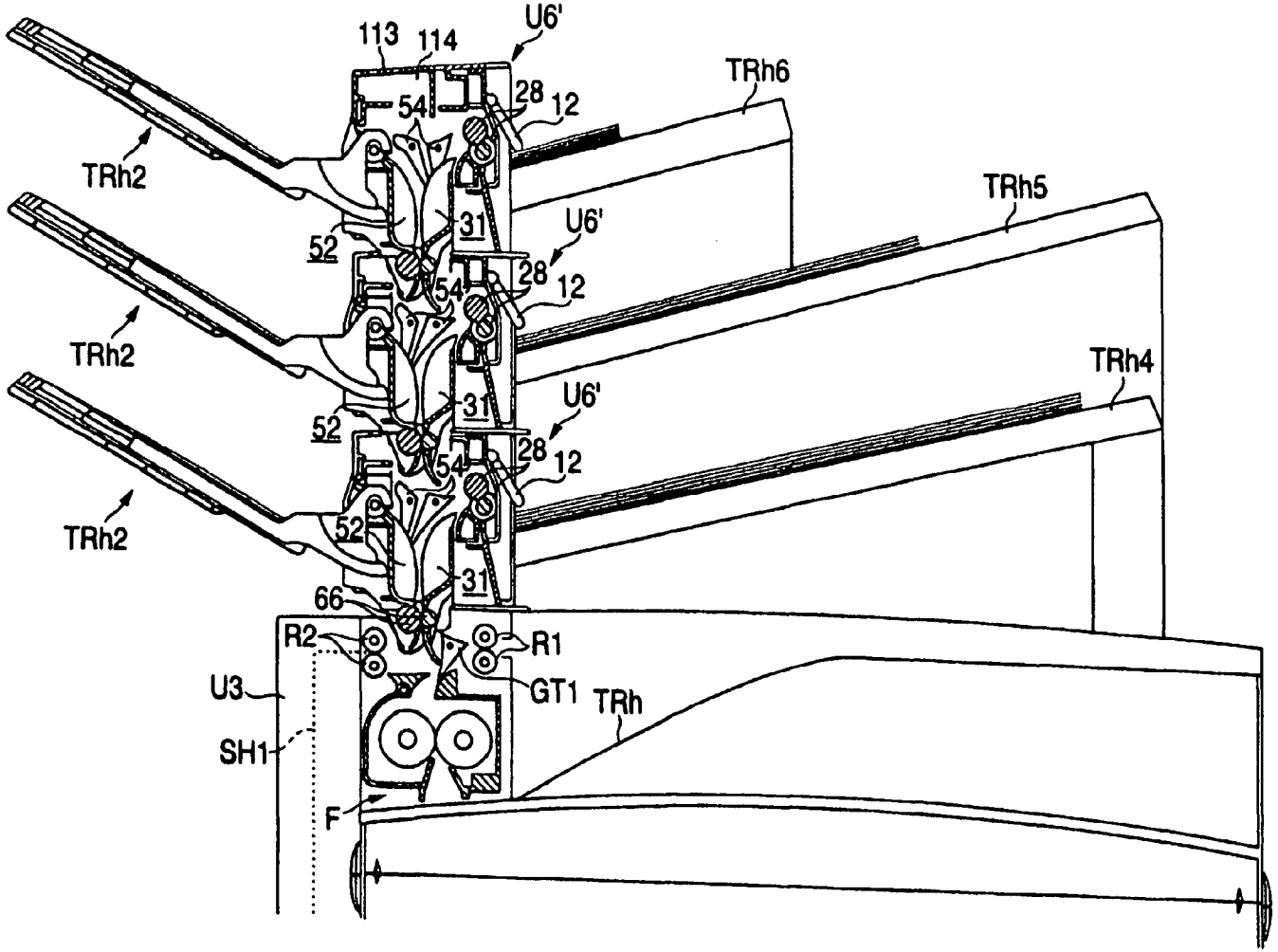
FIG. 25 is a cross-sectional explanatory view of an essential portion of an image forming apparatus of a fourth embodiment.

FIG. 25 is a cross-sectional explanatory view of an essential portion of an image forming apparatus of a fourth embodiment.

Figure 26:
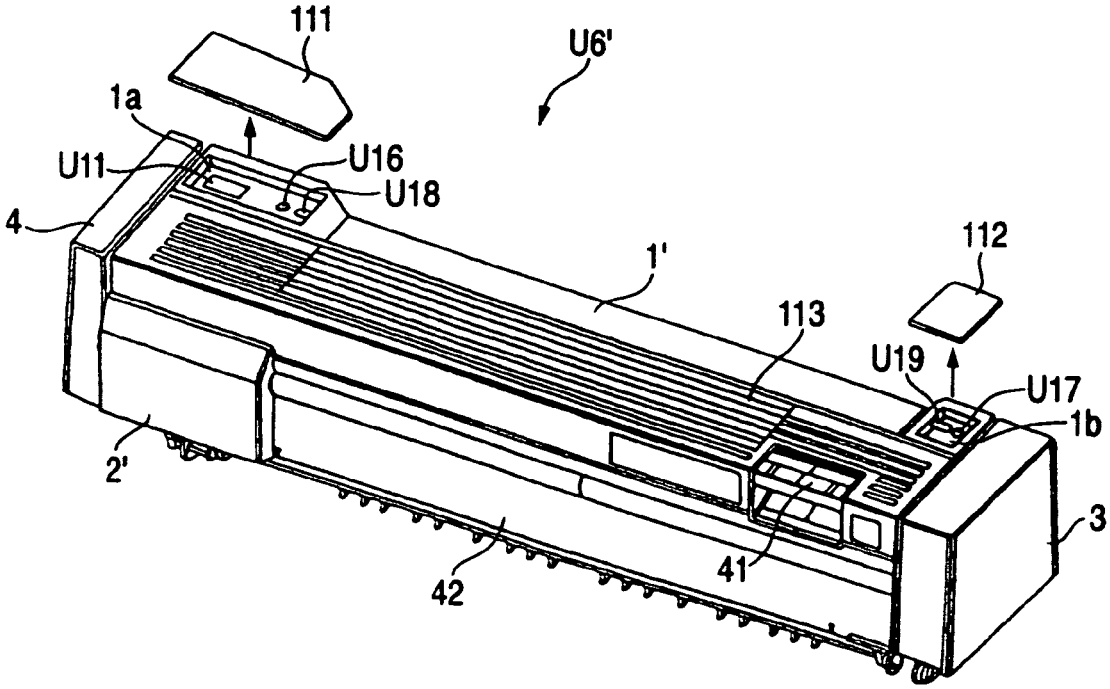
FIG. 26 is a perspective explanatory view of the optional discharge unit of the fourth embodiment, and is a view corresponding to FIG. 6A of the first embodiment.

FIG. 26 is a perspective explanatory view of the optional discharge unit of the fourth embodiment, and is a view corresponding to FIG. 6A of the first embodiment.

In the descriptions of the fourth embodiment, structural elements corresponding to those of the first embodiment are denoted by the same reference numerals, and detailed description thereof is omitted.

The fourth embodiment differs from the first embodiment in the following respects, but in other respects is configured in the same manner as is the first embodiment.

In the printer U' of the fourth embodiment in FIG. 25, an optional face-down tray TRh4 is attached to the rear end of the printer main body U1', and an optional face-down tray TRh5 is attached above the optional face-down tray TRh4. Further above the same, an optional face-down tray TRh6 for paper of a smaller size is attached.

As shown in FIG. 25, to the printer U'; that is, an image forming apparatus of the fourth embodiment, three optional discharge units U6' are attached in such a manner that the operational discharge unit U6' can be added one above the other. As shown in FIGS. 25 and 26, an upper-rear-surface cover 111 is attached to the upper face of the rear end of a face-down-side case 1' of the optional discharge unit U6' of the fourth embodiment; and an upper-front-surface cover 112 is attached to the upper surface of the front rear end of the same.

When the upper-rear-surface cover 111 is removed, a rear recess 1*a* for additional mounting formed at the rear end of the face-down-side case 1' is exposed. When the upper-front-surface cover 112 is removed, a front recess for additional mounting 1*b* formed at the front end of the face-down-side case 1' is exposed. A connector for additional mounting U11' which is configured in the same manner as in the main-body-side connector U11, a rear optional discharge unit positioning hole U16, and a rear optional discharge unit lock pin U18 are disposed in the rear recess for additional mounting 1*a*. A front optional discharge unit positioning hole U17 and a front optional discharge unit lock pin U19 are disposed in the front recess for additional mounting 1*b*.

Therefore, in the optional discharge unit U6' of the fourth embodiment, the mounting lock member (member mounted by additional discharge device) 16 or the mount-positioning pins (member mounted by additional discharge device) 18, 18 are disposed so as to face downward in accordance with the connector U11' for additional mounting; the optional discharge unit positioning holes (additional discharge unit mounting members) U16, U17; and the optional discharge unit lock pins (additional discharge unit mounting members) U18, U19. Meanwhile, the main-body-side connector U11 of the printer main body U1'; the optional discharge unit positioning holes U16, U17; or the optional discharge unit lock pins U18, U19 are disposed on the upper end surface in accordance with the mounting lock member 16 of the optional discharge unit U6' or mount-positioning pins 18, 18. Therefore, the optional discharge unit U6' of the fourth embodiment is attached to the printer main body U1' or to the optional discharge unit U6' from above, in contrast to the first to third embodiments wherein the same is attached to the printer main body U1' from the left (laterally). At the time of attachment, the optional discharge unit U6' is electrically connected by means of the connector.

As shown in FIGS. 25 and 26, an additional discharge device mounting section cover 113 is attached on the right of the center in the front-and-rear direction of a face-up-side case 2'. When the additional discharge device mounting section cover 113 is removed, an additional discharge device mounting section 114 (see FIG. 25) is exposed.

As shown in FIG. 25, the optional discharge unit U6' of the fourth embodiment has a tray-switching gate 54' which can move between the face-up discharge position, the face-down discharge position, and an additional device transport position, in place of the tray-switching gate 54 of the first embodiment which can move between the face-up discharge position and the face-down discharge position.

An unillustrated pair of solenoids and springs are attached to the tray-switching gate 54', and through on-off control of the pair of solenoids, the tray-switching gate 54' is caused to move between the face-up discharge position, the face-down discharge position, and the additional device transport position. The face-up discharge position (tray discharge position, the position indicated by the tray-switching gate 54' of the top tray in FIG. 25) is a position from which a sheet is discharged to the optional face-up tray TRh2. The face-down discharge position (tray discharge position, the position indicated by the tray-switching gate 54' of the second-from-the-top tray in FIG. 25) is a position from which a sheet is discharged to the optional face-down tray TRh4, TRh5. The additional device transport position (the position indicated by the tray-switching gate 54' of the third-from-the-top tray in FIG. 25) is a position from which a sheet is transported to the optional discharge unit U6' which is additionally attached above. A configuration for moving the tray-switching gate 54' by means of the pair of solenoids and springs is conventionally known (see, e.g., JP-A-7-315668), and detailed description thereof is omitted.

Effects of Fourth Embodiment

In the printer (image forming apparatus) U' of the fourth embodiment configured as above, the optional discharge unit U6' can be added by means of mounting from above sequentially. Therefore, the optional face-up tray TRh2 and the optional face-down trays TRh4 to TRh6 can be easily increased or decreased in number as required by an user.

MODIFICATION EXAMPLES

Hithertofore, embodiments of the invention have been described in detail. However, the invention is not limited thereto, and can be modified in various manners within the scope of the invention as set forth in the added claims. Modification examples (1) to (6) of the invention will be described hereinbelow.

(1) The respective embodiments are not limited to an image forming apparatus of an electro-photographic type, and can be applied to that of an ink-jet printing type.

(2) The first to third embodiments are configured such that solely the single optional discharge unit U6 is attached; however, a configuration wherein plural optional discharge units U6 arranged vertically are attached is also applicable.

(3) In the fourth embodiment, the tray-switching gate 54' is configured so as to be able to move between three positions: the face-up discharge position (tray discharge position), the face-down discharge position (tray discharge position), and the additional device transport position. However, for instance, in a case where the face-down tray is not attached, the tray-switching gate 54' can be configured so as to be able to move between two positions consisting of the face-up discharge position (tray discharge position) and the additional device transport position.

(4) In the respective embodiments, the common transport path transport rollers 60 are disposed at the lower end of the optional discharge unit (optional discharge device) U6, U6'; however, the rollers can be disposed at the upper end of the image forming apparatus main body U1 at the upper end of the optional discharge unit U6'.

(5) In the respective embodiments, the sheet reverse path SH1 is disposed in the sheet-reversing unit which is detachable in relation to the image forming apparatus U1, U1'; however, the path can be disposed inside the image forming apparatus main body.

(6) In the respective embodiments, the tray-switching gate 54 is disposed at a position where the face-down transport path 61 and the face-up transport path 62 branch off from the common transport path 63. However, tray-switching gates can be disposed respectively at a face-down branching position and a face-up branching position by means of vertically offsetting the face-down branching position, where the face-down transport path 61 branches off from the common transport path 63, and the face-up branching position, where the face-up transport path 62 branches off from the same.

The entire disclosure of Japanese Patent Application No. 2004-104163 filed on Mar. 31, 2004 including specification, claims, drawings and abstract is incorporated herein by reference in its entirety.

What is claimed is:

1. An image forming apparatus comprising:

a main body discharge tray disposed in a main body of the image forming apparatus and having a sheet placing surface onto which a sheet with an image recorded thereon is discharged;

a main body discharge member that comprises a main body discharge roller discharging the sheet onto the main body discharge tray;

a reverse path transport roll that is located in the main body discharge member and located in a substantial-opposite side of the main body discharge roller;

an optional discharge device disposed above the main body discharge member, the optional discharge device having an optional transport path through which the sheet, on which an image has been recorded in the image forming apparatus main body, passes wherein the optional discharge device comprises:

a common transport roller that is provided at a protruding portion of the optional discharge device and that transports the sheet to bring the sheet from the main body discharge member into the optional discharge device;

a face-down discharge roller that is disposed inside the optional discharge device and that is configured to discharge the sheet having passed through the optional transport path to an upper portion of a postprocessing transport device disposed above the main body discharge tray;

a face-up discharge roller that is disposed inside the optional discharge device and in a substantial opposite side of the face-down discharge roller and, that is configured to discharge the sheet having passed through the optional transport path to an optional tray;

a sheet reversing device that is detachably attached to the main body of the image forming apparatus to perform double-sided printing;

a postprocessing device that performs postprocessing of the sheet on which an image has been recorded, wherein the postprocessing device is disposed on the opposite side of the sheet reversing device; and wherein the postprocessing transport device has:

a lower portion which is supported on the sheet placing surface of the main body discharge tray;

an upper portion on an upper surface of which the sheet discharged from the optional discharge device is placed; and a postprocessing transport path formed between the lower portion and the upper portion, the postprocessing transport path transporting the sheet discharged from the main body discharge member to the postprocessing device, the postprocessing transport path has a substantially horizontal linear shape, the postprocessing transport path is level with the main body discharge member, and wherein the face-down discharge roller, the common transport roller and the reverse path transport roll cooperate to transport the sheet for performing the double-sided printing.

2. The image forming apparatus according to claim 1, wherein at least one of the optional discharge device, postprocessing device and postprocessing transport device is detachably attached to the image forming apparatus main body.

3. The image forming apparatus according to claim 1, further comprising an image-reading section disposed above the image forming apparatus main body, wherein the postprocessing transport device is disposed between the image forming apparatus main body and the image-reading section.

4. The image forming apparatus according to claim 2, further comprising an image-reading section disposed above the image forming apparatus main body, wherein the postprocessing transport device is disposed between the image forming apparatus main body and the image-reading section.

5. The image forming apparatus according to claim 1, wherein the postprocessing transport path includes a plurality of transfer rollers.

6. The image forming apparatus according to claim 2, wherein the postprocessing transport path including a plurality of transfer rollers.

7. The image forming apparatus according to claim 1, wherein the optional tray is detachably attached to the optional discharge device.

8. The image forming apparatus according to claim 7, wherein the optional discharge device selectively discharges the sheet which has passed through the optional transport path to either one of the optional tray attached to the optional discharge device and the upper portion of the postprocessing transport device.

9. The image forming apparatus according to claim 7, wherein the optional discharge device further includes a tray detection sensor that detects that the optional tray is attached in a state where a sheet can be discharged thereon.

10. The image forming apparatus according to claim 1, wherein the common transport roller and the face-down discharge roller are configured to convey the sheet to the sheet reversing device through the main body of the image forming apparatus.

11. The image forming apparatus according to claim 1, wherein the optional discharge device includes a detection sensor to determine whether or not a sheet can be discharged.

12. The image forming apparatus according to claim 7, wherein the optional discharge device includes another detection sensor to determine whether or not a sheet can be discharged to the optional tray.

13. The image forming apparatus according to claim 1, wherein the optional discharge member includes a drive roller and a corrugated roller.

* * * * *